US007740193B2

(12) United States Patent
Soller et al.

(10) Patent No.: US 7,740,193 B2
(45) Date of Patent: Jun. 22, 2010

(54) CLEANING DEVICE WITH PRESET LOCKABLE SWIVEL HEAD

(75) Inventors: Douglas A. Soller, Racine, WI (US); Cathal L. Fahy, Columbus, OH (US)

(73) Assignee: S.C. Johnson & Son, Inc., Racine, WI (US)

( * ) Notice: Subject to any disclaimer, the term of this patent is extended or adjusted under 35 U.S.C. 154(b) by 1085 days.

(21) Appl. No.: 10/818,411

(22) Filed: Apr. 5, 2004

(65) Prior Publication Data

US 2004/0182952 A1 Sep. 23, 2004

Related U.S. Application Data

(63) Continuation-in-part of application No. 10/385,982, filed on Mar. 10, 2003, now Pat. No. 6,889,917.

(51) Int. Cl.
*B05B 7/02* (2006.01)

(52) U.S. Cl. ..... 239/525; 15/144.1; 15/144.2

(58) Field of Classification Search ..... 15/144, 15/172, 228, 231, 244, 144.1, 144.2; 403/1, 403/53, 61, 73, 85, 57, 58; 401/138, 139, 401/140; 239/525

See application file for complete search history.

(56) References Cited

U.S. PATENT DOCUMENTS

| | | | | | |
|---|---|---|---|---|---|
| 1,595,901 | A | | 8/1926 | Mahler | |
| 1,800,349 | A | * | 4/1931 | Hurason | 403/57 |
| 2,763,517 | A | * | 9/1956 | Strand | 403/58 |
| 2,802,230 | A | | 8/1957 | Maddox | |
| 2,854,683 | A | * | 10/1958 | Warden | 15/144.2 |
| 2,967,320 | A | * | 1/1961 | Short | 15/147.2 |
| 3,360,286 | A | * | 12/1967 | Smyth | 403/148 |
| 3,713,744 | A | | 1/1973 | Sims | |
| 3,778,860 | A | * | 12/1973 | Thielen | 15/147.2 |
| 3,850,533 | A | * | 11/1974 | Thielen | 403/58 |
| 3,964,160 | A | * | 6/1976 | Gordon | 30/531 |
| 3,991,431 | A | * | 11/1976 | Thielen | 15/147.2 |
| 4,225,998 | A | * | 10/1980 | Thielen | 15/231 |
| 4,819,293 | A | * | 4/1989 | Nicholson | 15/172 |
| 4,986,587 | A | * | 1/1991 | Lozano | 294/1.4 |
| 5,379,723 | A | * | 1/1995 | Branley | 119/601 |
| 5,926,896 | A | | 7/1999 | Allemann et al. | |
| 6,009,887 | A | | 1/2000 | Hertel | |
| 6,301,740 | B1 | | 10/2001 | Quiroz | |
| 6,481,041 | B1 | | 11/2002 | Ingram | |
| 6,540,424 | B1 | * | 4/2003 | Hall et al. | 401/140 |
| 6,893,180 | B2 | * | 5/2005 | Hall et al. | 401/140 |
| 6,899,485 | B2 | * | 5/2005 | Hall et al. | 401/140 |
| 6,964,535 | B2 | * | 11/2005 | Bell et al. | 401/140 |
| 6,976,802 | B2 | * | 12/2005 | Hall et al. | 401/140 |
| 7,163,349 | B2 | * | 1/2007 | Policicchio et al. | 401/137 |
| 7,191,486 | B1 | * | 3/2007 | Michelson et al. | 15/228 |
| 2001/0037534 | A1 | | 11/2001 | Bryan | |
| 2002/0078518 | A1 | | 6/2002 | Jiang | |

(Continued)

*Primary Examiner*—Mohammad M Ali

(57) ABSTRACT

A trigger actuated aerosol spray cleaning device has a cleaning head that swivel or be locked in different preset discrete angular positions relative to the device. The cleaning head pivotally mounts onto a swivel part of a coupler at and end of the device. In one position, a sliding swivel lock permits rotation of the swivel and in a locking position it prevents relative rotation by engaging one of several slots in the swivel. The slots are located so that the cleaning head can be centered (perpendicular) relative to the device or held at an oblique angle as may be desired for cleaning corners or other tight spaces.

11 Claims, 19 Drawing Sheets

U.S. PATENT DOCUMENTS

2003/0009839 A1 1/2003 Streutker et al.
2003/0009840 A1* 1/2003 Karsten ..... 15/230.11
2004/0071490 A1* 4/2004 Vosbikian et al. ..... 401/49
2004/0244131 A1* 12/2004 Cassar ..... 15/144.2
2005/0011536 A1* 1/2005 Hofte et al. ..... 134/6
2005/0227900 A1* 10/2005 Veltman ..... 510/424
2006/0000041 A1* 1/2006 Streutker et al. ..... 15/144.1
2007/0204418 A1* 9/2007 Vales ..... 15/172

* cited by examiner

FIG. 7
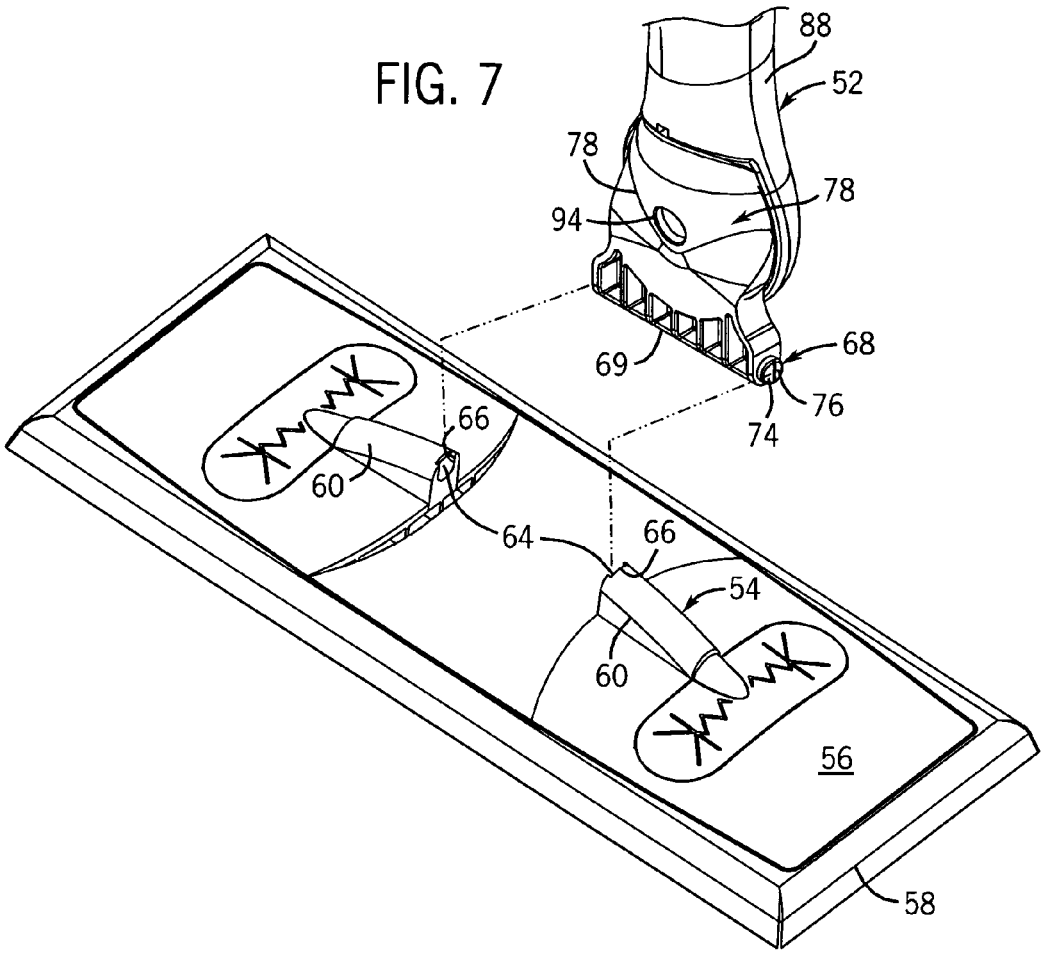
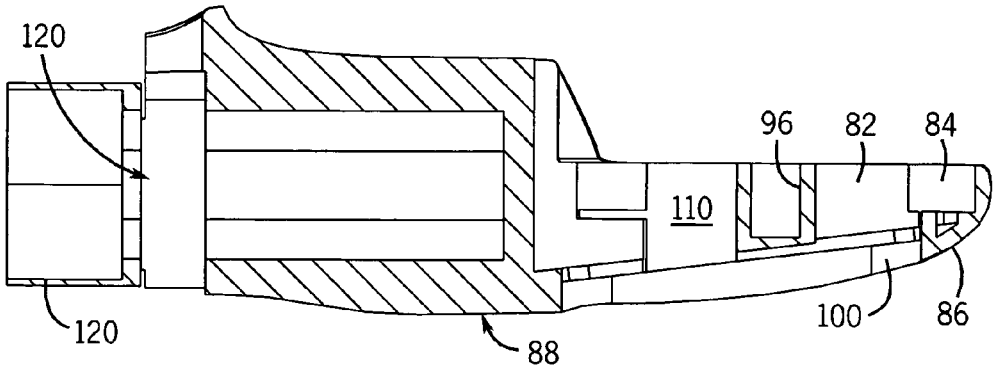
FIG. 17

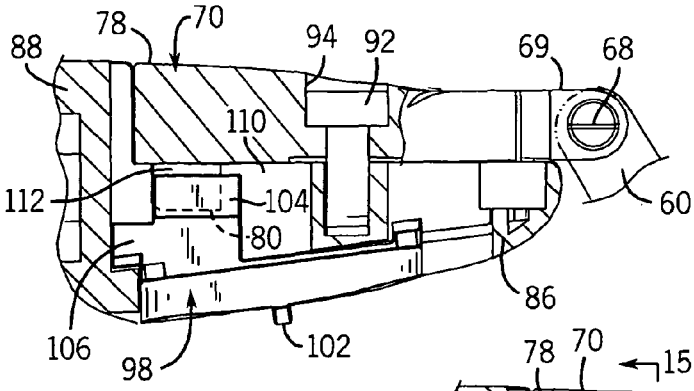
FIG. 13
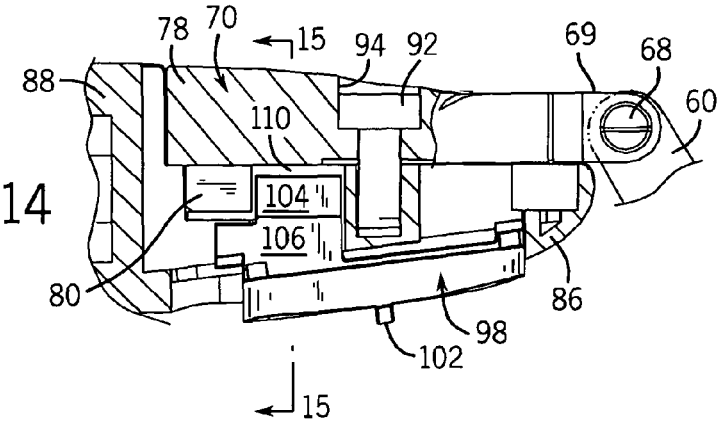
FIG. 14
FIG. 16
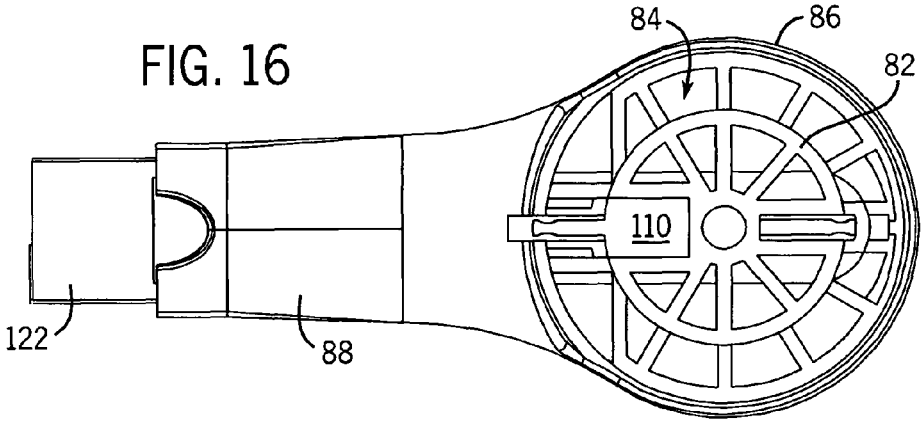
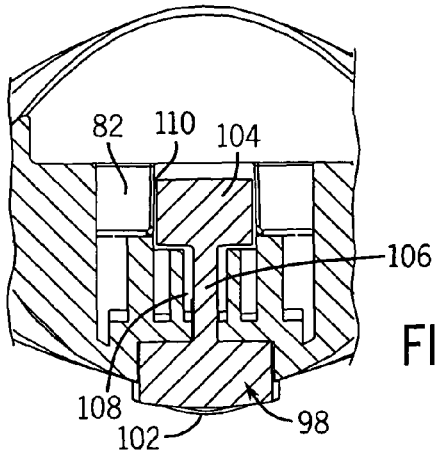
FIG. 15

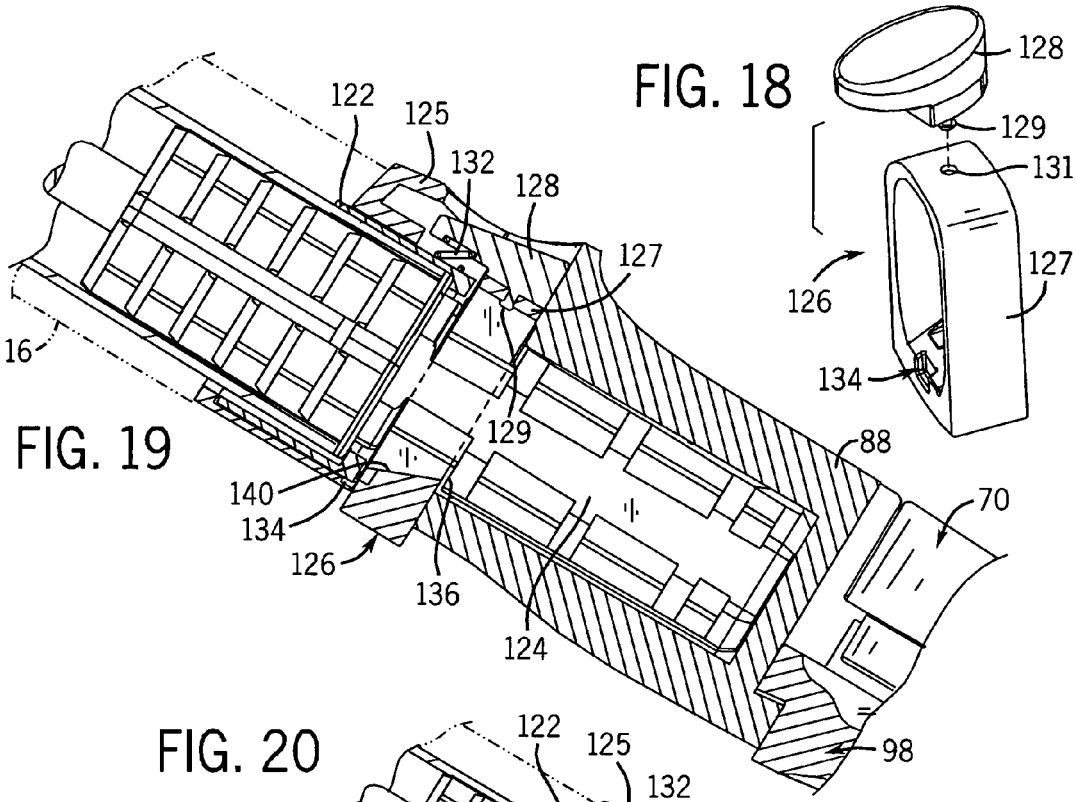
FIG. 19
FIG. 18
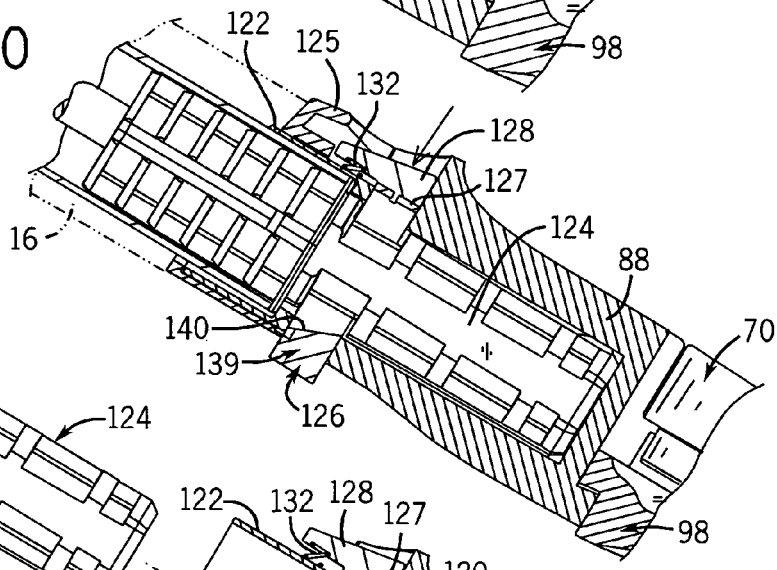
FIG. 20
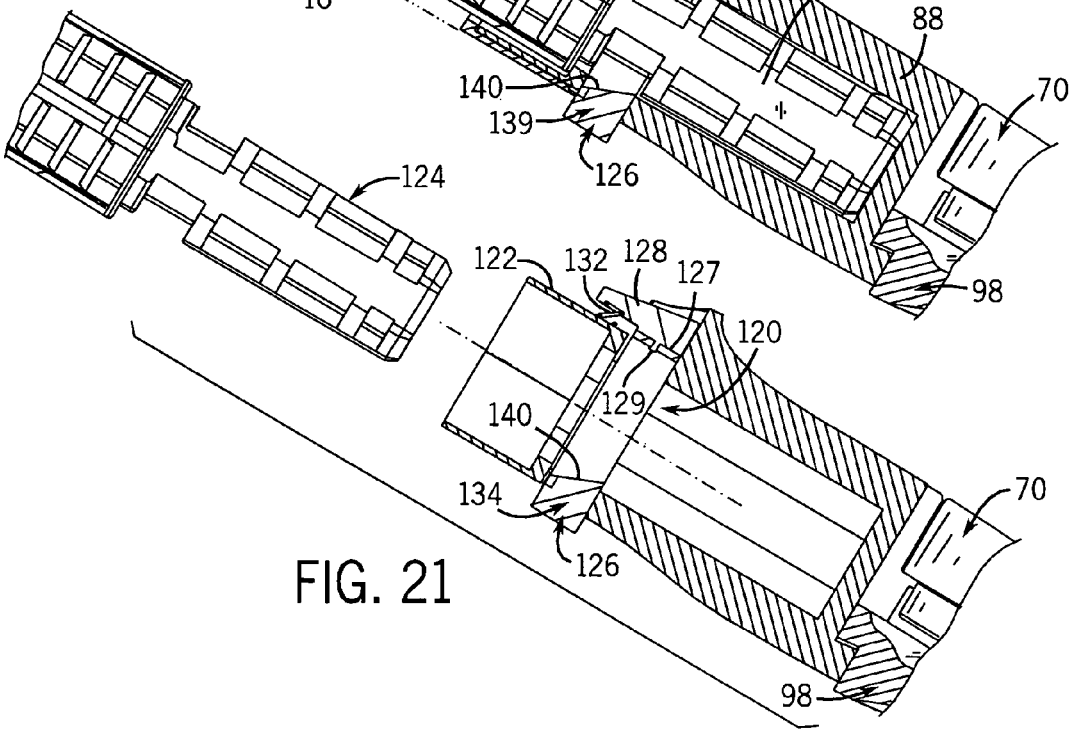
FIG. 21

CLEANING DEVICE WITH PRESET LOCKABLE SWIVEL HEAD

CROSS-REFERENCE TO RELATED APPLICATIONS

This application is a continuation-in-part application of U.S. patent application Ser. No. 10/385,982, filed on Mar. 10, 2003 now U,S, Pat. No. 6,889,917.

STATEMENT OF FEDERALLY SPONSORED RESEARCH/DEVELOPMENT

Not applicable.

FIELD OF THE INVENTION

The present invention relates to cleaning devices and in particular to cleaning devices with articulating cleaning heads.

BACKGROUND OF THE INVENTION

A variety of cleaning devices have been developed which permit a cleaning head to be adjustably attached to a handle so that the head can pivot and/or swivel at the end of the handle during use. It is desirable for the pivot or swivel action to be temporarily or optionally suspending if not wanted, for example when vigorously scrubbing a soiled area. It is also desirable at times for the cleaning head to be fixed in an angular position relative to the handle (be it perpendicular or at an oblique angle), for example as when cleaning a tight space or corner or perhaps when cleaning a window or other nearby upright surface. It is also desirable that the consumer be able to quickly select a desired position and easily lock the head in the selected position. Releasing the head so that it is free to swivel should also be simple and intuitive. Additionally, it is desirable that the assembly provide a secure connection between the head and the handle in a simple motion with minimal requirement for the consumer to bend down to achieve the connection. Furthermore, it is desirable for the head to be removably attached to the handle to facilitate quick changing of the head when desired.

U.S. Pat. No. 2,802,230 discloses an articulating mop in which the mop head can swivel in a circular motion about the handle and in which the handle can pivot up and down relative to the mop head. The pivoting connection of this device allows for only about 90 degrees of pivoting and requires the consumer to twist the handle to rotate the head. Also, the disclosed mechanism does not provide for locking the head in either a perpendicular or oblique angular position. Furthermore, the head cannot be readily removed or interchanged with other types of heads.

U.S. Pat. No. 3,360,286 discloses another articulating mop head. Here, both the pivot and swivel action of a universal joint are controlled by nut and fastener connections. By loosening one or both of these connections the mop head can pivot and/or swivel with varied degrees of rigidity depending upon the looseness of the connections. Tightening each connection can prevent either or both of the articulating movements. This device has several shortcomings as well, for example, tools or a strong hand may be necessary to adjust the head and there are no preset centering or angular positions for the head to be moved into quickly. And again, the head is not readily removable or interchangeable.

U.S. Pat. No. 6,301,740 discloses a disposable brush having an extension handle. This device is not designed to articulate during use, however, it does provide for adjustment of the angular position of the head relative to the handle. Loosening a thumb screw loosens the engagement of one or more projecting ribs with surfaces of the handle to allow the head to be rotated. Once adjusted the thumb screw is retightened to hold the head in the new position. The ribs help prevent unintended rotation of the head during use, however, like they do not provide for quick re-positioning of the head in one or more discrete angular positions.

U.S. Pat. No. 6,551,001 discloses another type of mop cleaning device with an articulating head mounted via a universal joint type and having an aerosol can which sprays cleaning liquid in front of the cleaning head as the mop is used. It has a snap together assembly that is simple and intuitive, however, the connection is designed to be more permanent in nature once the connection is achieved and it does not provide for pre-set angular adjustments of the mop head.

Additional techniques for adjustably connecting cleaning heads to handles are disclosed in U.S. Pat. Nos. 3,713,744 and 5,926,896. The disclosures of these patents, and all other publications referred to herein, are hereby incorporated by reference as if fully set forth herein.

A need thus still exists for improved articulating connections of a cleaning head to a handle.

SUMMARY OF THE INVENTION

In one aspect the present invention provides a cleaning device having a handle, a cleaning head and a coupler joining the handle to the cleaning head. The coupler has a swivel and a lock movable with respect to the swivel. The lock and lock the swivel fixed with respect to the handle, or allow the swivel to rotate about a swivel axis which is other than an axis of connection of the cleaning head to the coupler. The lock releasably locks the swivel in one of a plurality of discrete angular positions between which the swivel can rotate about the swivel axis without being locked.

The cleaning head is releasably lockable in one of a plurality of preset angular positions relative to the handle. The preset angular positions can include a centered position in which the a cleaning head is perpendicular to the handle and an angled position in which the cleaning head is at an oblique angle to the handle.

In preferred forms, the swivel defines a plurality of slots angularly spaced apart from one another. A centering slot is located so that when in the locked position the swivel lock can be disposed in the centering traveling slot such that the cleaning head is perpendicular to the handle. An angling slot is located so that when in the locked position the swivel lock can be disposed in the angling slot so that the cleaning head is at an oblique angle to the handle. Even more preferably, there are at least three slots angularly spaced apart between 10 and 45 degrees, for example at 10, 12 and 2 o'clock. The swivel lock can slide between locked and unlocked positions relative to the swivel and has a thumb grip extending to one side of the coupler for sliding the lock. The swivel lock can also have a stop sized fit into the slots.

In another preferred form, the cleaning head is pivotally connected to the swivel along a pivot axis, and preferably coupled in a one-way snap together releasable locking pivot connection. That is, the two parts snap together quickly without any special relative positioning and without first moving setting any latching components. And, the parts are locked together, in a pivotal connection, until released by the press of a button. This connection allows the handle of the device to pivot nearly 180 degrees between the front and back sides of the cleaning head. The cleaning head can swivel, in addition to pivoting, nearly 120 degrees between lateral sides of the cleaning head.

In other preferred forms, the coupler can be a separate part connected to the handle or body of the cleaning device, or a stationary part of the coupler can be an integral or unitary part thereof. And, an aerosol canister assembly can be included for delivering a chemical from a canister to a desired location adjacent the cleaning head. The handle is part of a grip assembly having a trigger for moving an actuator assembly causing the chemical is to be dispensed from the canister when the trigger is depressed.

These and other advantages of the invention will be apparent from the detailed description and drawings. It should be understood that the following merely provides preferred embodiments of the invention. The claims should be looked to in order to understand the full scope of the invention.

BRIEF DESCRIPTION OF THE DRAWINGS

FIG. 7 is an exploded perspective view showing a quick disconnect coupler separated from the cleaning head;

FIG. 13 is a partial detail cross-sectional view taken along line 13-13 of FIG. 4 showing the swivel connection of the coupler with a swivel locking element in an unlocked position;

FIG. 14 is a view similar to FIG. 13 although showing the swivel locking element in a locked position disabling swivel movement;

FIG. 15 is a partial detail cross-sectional view taken along line 15-15 of FIG. 14;

FIG. 16 is a bottom plan view of a coupler body isolated from the swivel and swivel locking element;

FIG. 17 is a side cross-sectional view taken along line 17-17 of FIG. 11;

FIG. 18 is an exploded perspective view of a latch ring;

FIG. 19 is a partial cross-sectional taken along line 19-19 of FIG. 9 showing a plug end of a main body of the device locked into a socket end of the coupler;

FIG. 20 is a view similar to FIG. 19 showing the latch ring moved into a release position out of engagement with the plug end;

FIG. 21 is a view similar to FIG. 19 showing the plug and socket arrangement disconnected;

DETAILED DESCRIPTION OF THE PREFERRED EMBODIMENTS

The present invention provides a trigger actuated cleaning device using an aerosol spray canister to dispense a cleaning agent. The primary focus of this application is a quick disconnect coupler for the cleaning head allowing it to pivot with at least two degrees of freedom. The other components of the cleaning device will be described briefly here, however, a better understanding of a device with similar components can be found in co-pending U.S. application Ser. No. 09/951,632, filed on Sep. 14, 2001 (now allowed), which is hereby incorporated by reference as though fully set forth herein.

Figure 1:
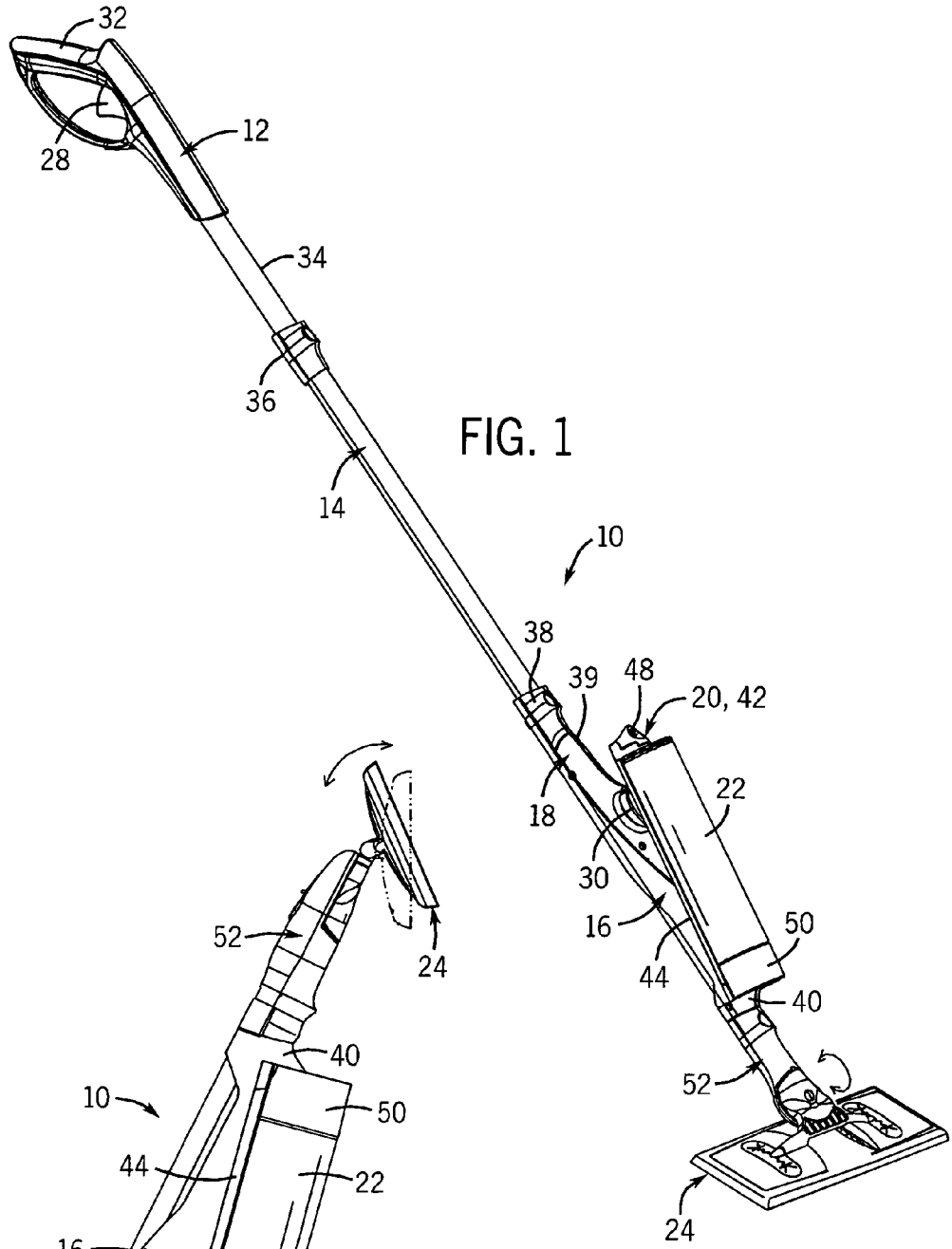
FIG. 1 is a perspective view of a cleaning device having a quick disconnect mounted cleaning head, shown with a remote grip assembly at the end of an extension wand.
Figure 2:
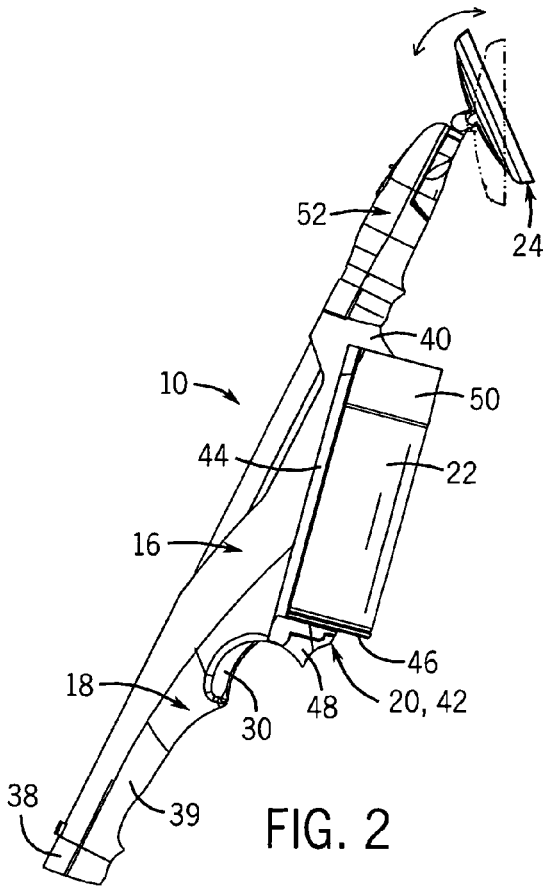
FIG. 2 is a side view of the cleaning device with the extension wand and remote grip assembly removed.

FIG. 1 of the drawings shows the cleaning device 10 of the present invention fully assembled in a mop-like configuration for cleaning floors or out of reach vertical or horizontal surfaces. FIG. 2 shows the cleaning device 10 with an extension wand removed so as to be shorter for cleaning nearby surfaces and to be more suitable for holding upright when cleaning close vertical surfaces, such as windows for example.

Figure 3:
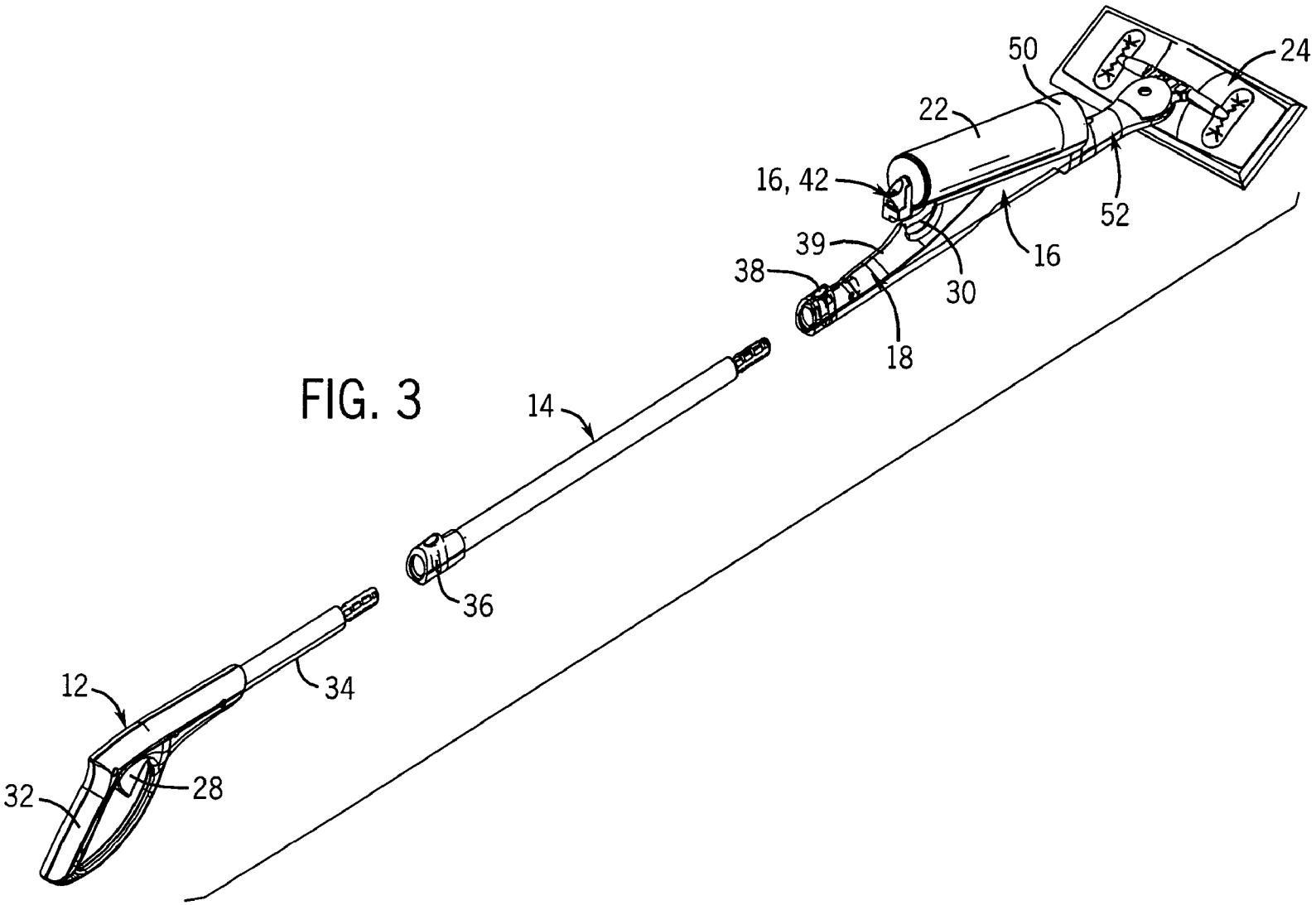
FIG. 3 is an exploded perspective view of the cleaning device as shown in FIG. 1.

With reference to these two figures and FIG. 3, the cleaning device 10 includes as major components a remote grip assembly 12, an extension wand 14, a main body 16 having its own grip assembly 18 and an adjustable retainer assembly 20 holding a canister 22, and a cleaning head 24. Internal to many of these components is a movable actuator assembly (not shown) linking triggers 28 and 30 of the two grip assemblies 12 and 18, respectively, to the valve of the canister 22 for spraying cleaner contained therein near the cleaning head 24.

The remote grip assembly 12 includes a hollow (two-piece) plastic pistol grip housing defining a handle 32 and the pivotally mounted trigger 28 to be operable by an index finger when gripping the handle 32. A hollow shaft extension 34 which plugs into a quick connect socket 36 at one end of the extension wand 14. Similarly, the opposite end of the extension wand 14 plugs into a quick connect socket 38 at the end of the main body 16. The ends of the shaft extension 34 and the extension wand 14 are identical as are the sockets 36 and 38, thus if desired, the extension wand 14 can be removed from the assembly so that the remote grip assembly 12 can by directly connected to the main body 16. As mentioned above and shown in FIG. 2, the remote grip assembly 12 and the extension wand 14 can be detached and the device operated by trigger 30 and held by handle 39 of the main body 16. The grip assembly 12, the extension wand 14 and the main body 16 houses core pieces (not shown) of the actuator assembly that slide in response to movement of either of the triggers 28 and 30 and in turn pivot an actuator lever 314 (see FIG. 25) operating the valve of the canister 22.

The canister 22 is aligned and mounted to the main body 16 by the retainer assembly 20, having a toe stop 40, through which an end of the actuator lever protrudes when the triggers 28 and 30 are depressed, a T-shaped rail (not shown) and a heel assembly 42 having a slide 44 riding on the rail. A locking tab (not shown) formed in the rail clicks into one of two receivers at two preset adjustment locations to alternatively hold full or compact sized canisters. A mechanism at the back of the slide 44 has a spring biased latch (not shown) that engages an inside surface of a rim 46 at the bottom of the canister 22. The latch is operated by a thumb operated release lever 48, which when depressed clears the latch from the canister 22. Releasing the release lever 48 resets the latch so that another canister can be snapped in place.

In operation, a user generally utilizes the cleaning device like any conventional poled or hand-held cleaning aerosol device. When the user desires to spray cleaner onto the surface being cleaned, the user simply squeezes either trigger 28 or 30, which pivots a hinged part of an overcap 50 on the canister 22 which in turn moves a valve stem (not shown) to open the canister valve and spray out cleaner. When the triggers 28 and 30 are released, springs (not shown) bias the actuator assembly to its original, non-activated position, which allows the canister valve to close and stop spraying.

Figure 4:
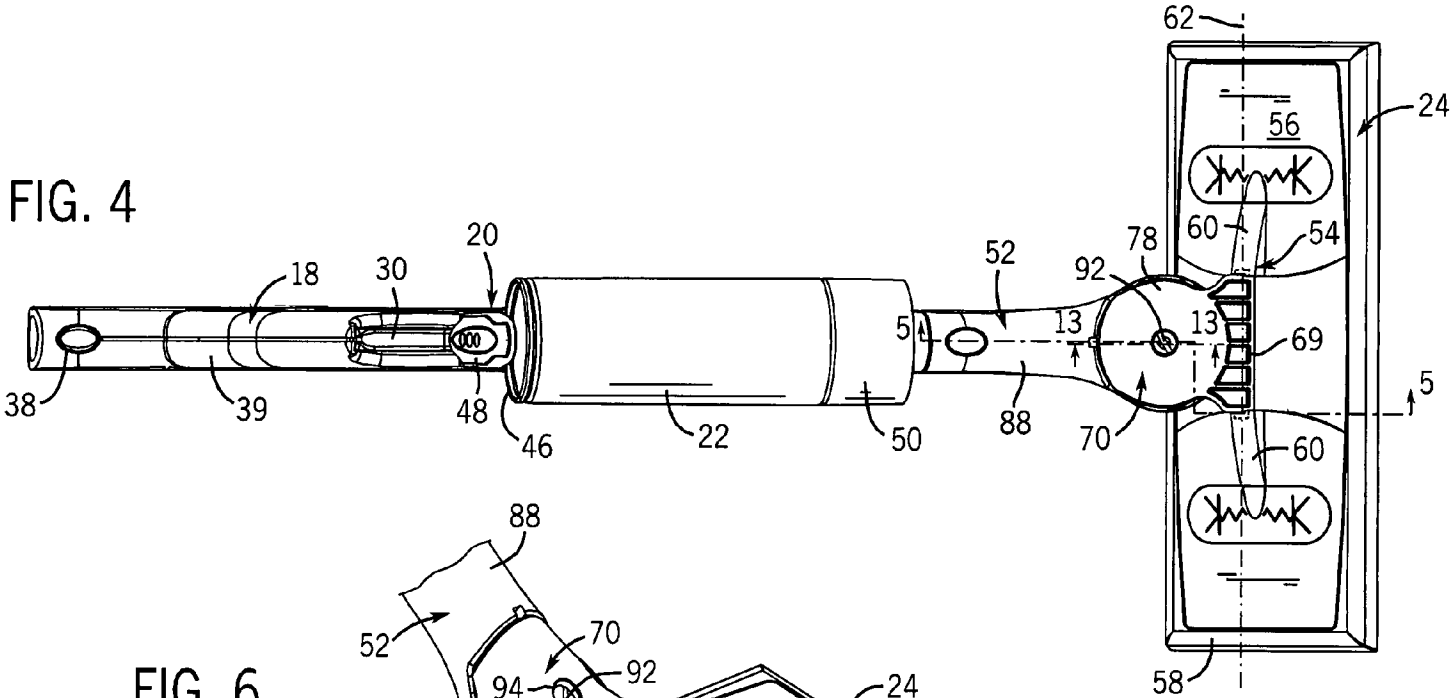
FIG. 4 is a top view of the cleaning device as shown in FIG. 2.
Figure 6:
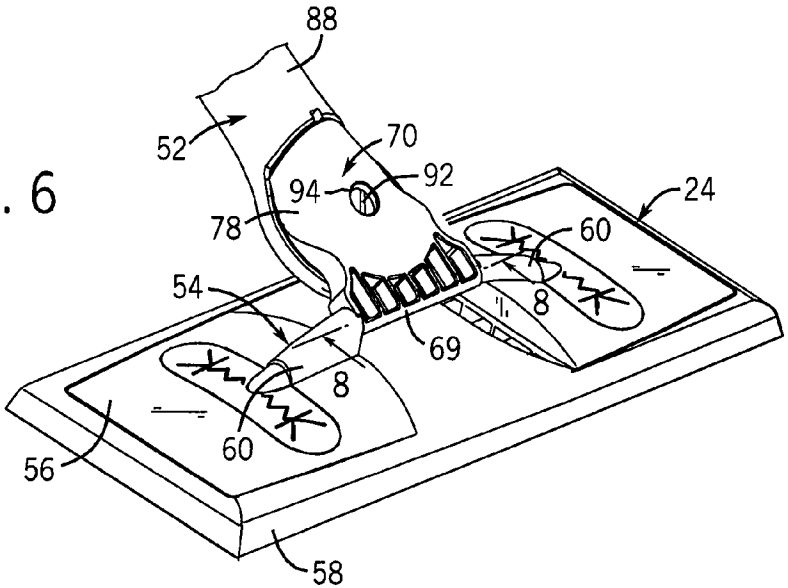
FIG. 6 is a partial perspective view of the cleaning head.

Referring now to FIGS. 4 and 6, the opposite end of the main body 16 connects to the cleaning head 24, as described in detail below, by a quick disconnect coupler 52 mounted to a pivot mount 54 formed as an integral part of the a backing plate 56 supporting a compressible pad 58. The pad 58 can be a substrate for mounting a cleaning cloth or dusting sheet or it may be a sponge or scrubber pad. The plate 56 and pad 58 could of course be replaced by a bristled brush head, wiper blade or any other suitable cleaning implement desired.

More specifically, referring to FIGS. 5-8, the pivot mount 54 is actually two upstanding fixed mounts 60 spaced apart along a pivot axis 62 defining facing pivot grooves 64 with upper notches 66. The two pivot grooves 64 are sized to receive two pivot bosses 68 on opposite lateral sides of a flared section 69 of a swivel 70 component of the coupler 52. The bosses 68 have tapered surfaces 74 that facilitate camming the pivot bosses 68 into the pivot grooves 54 through the notches 66 during assembly. The flat surfaces 76 of the pivot bosses 68, however, resist separation during normal use. Thus, when assembling or disassembling this pivot connection, the coupler 52 should be oriented so that the tapered surfaces 74 are the leading surfaces.

Referring to FIGS. 8-12 and 16, the swivel 70 has a generally circular section 78 with a ribbed ring 80 that fits around a hub 82 in an annular recess 84 at a round end 86 of a coupler body 88. The swivel 70 and coupler body 88 are pivotally joined along a swivel axis 90 by a fastener 92 disposed through a central opening 94 of the swivel 70 and threaded into a bore 96 of the coupler body 88. The swivel axis 90 is disposed in a plane generally perpendicular to the plane containing the pivot axis 62. Ordinarily, the coupler body 88 is free to pivot about the swivel axis 90 until the flared section 69 is stopped by contact with the sides of the coupler body 88.

As shown in FIGS. 10-15, the coupler 52 includes a locking element 98 disposed in a recess 100 in the coupler body 88. The locking element 98 includes a grip section 102 and a stop 104 with a narrowed neck section 106 disposed through a slot 108 in the coupler body 88. The recess 100 and the slot 108 are longer than the respective grip 102 and neck 106 sections to permit the locking element 98 to slide between locked and unlocked positions with respect to the coupler body 88. As shown in FIGS. 14 and 15, when the locking element 98 is in the unlocked position, the stop 104 fits into a radial slot 110 in the hub 82 of the coupler body 88 clear from the ring 80 of the swivel 70. By sliding the locking element 98 to the locked position shown in FIG. 13, the stop 104 fits into a radial slot 112 in the ring 80 (aligned with slot 110) so as to interfere with the swivel 70 and prevent it from pivoting about swivel axis 90. This arrangement allows the swivel to be disabled quickly and easily when not needed or when a more rigid connection is desired.

Figure 5:
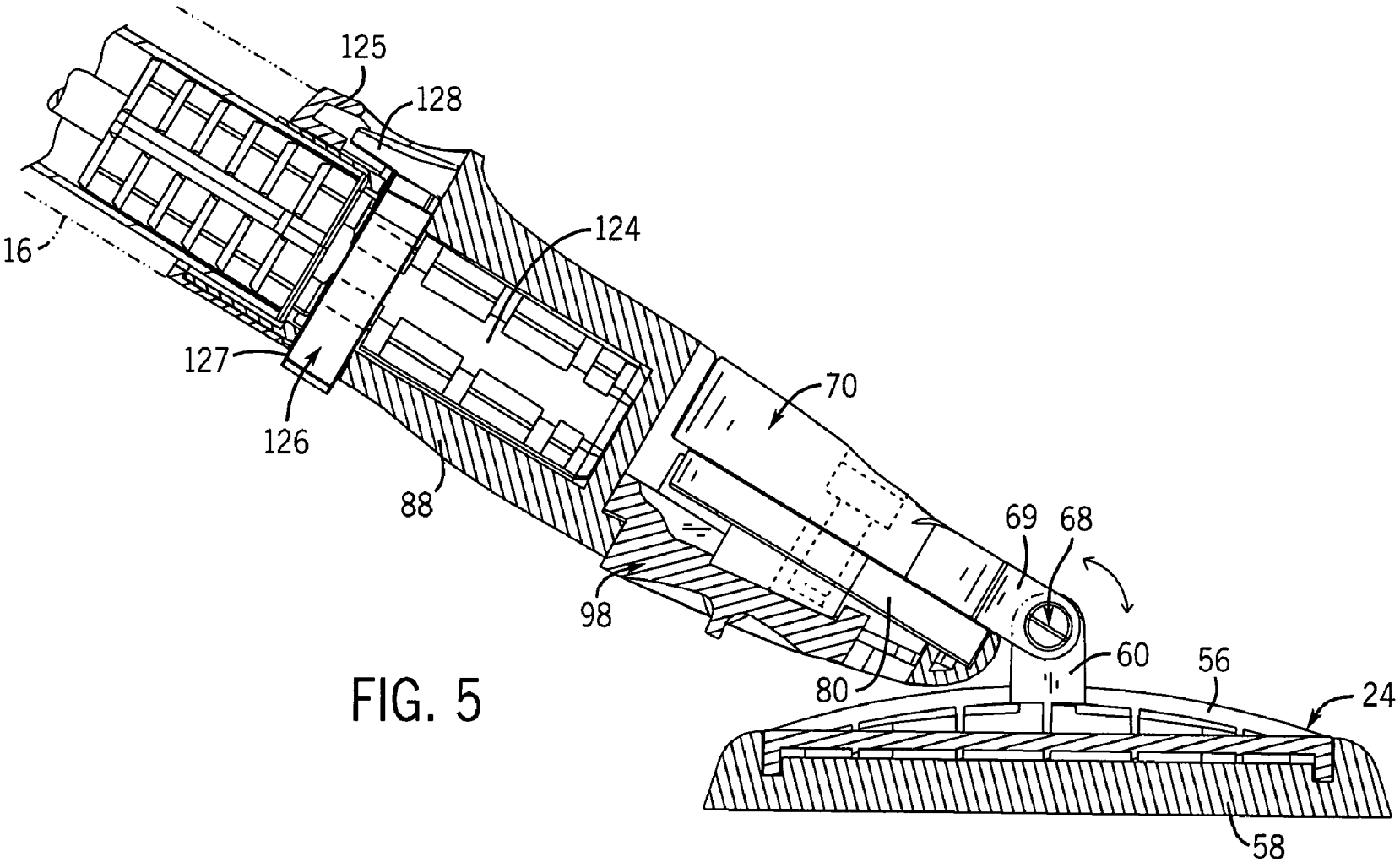
FIG. 5 is a partial cross-sectional view taken along line 5-5 of FIG. 4.
Figure 8:
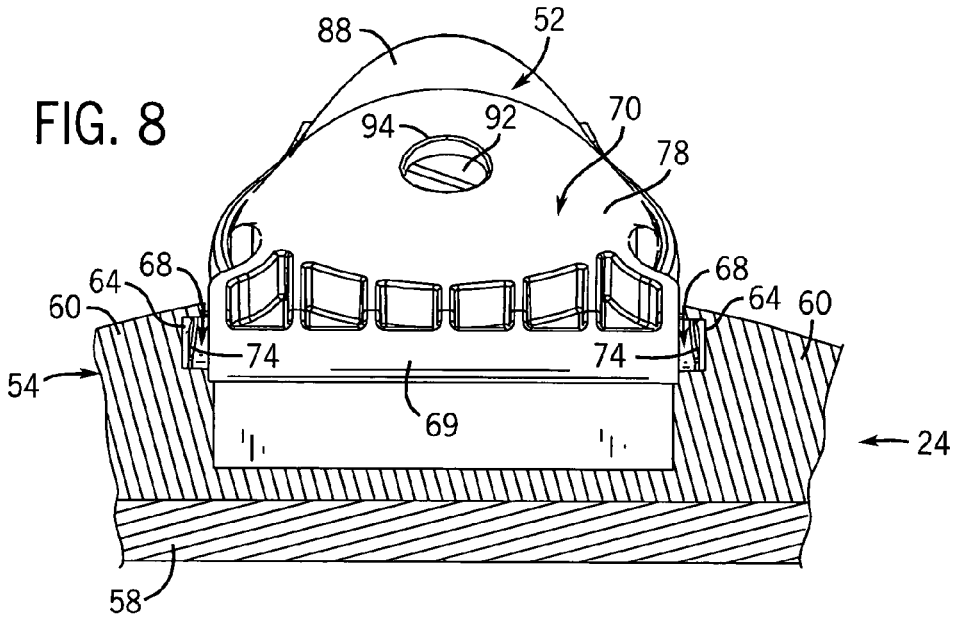
FIG. 8 is a partial cross-sectional view taken along line 8-8 of FIG. 6.
Figure 9:
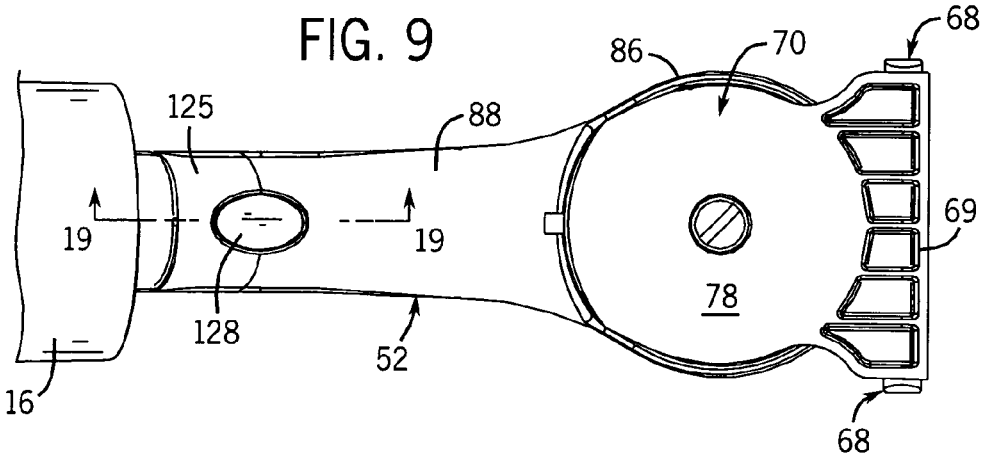
FIG. 9 is a partial plan view showing the coupler without the cleaning head.
Figure 10:
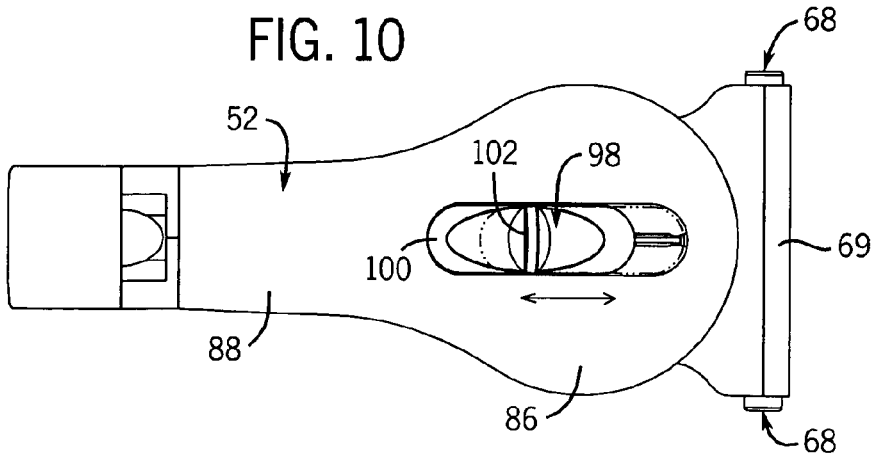
FIG. 10 is an opposite side plan view of the coupler.
Figure 11:
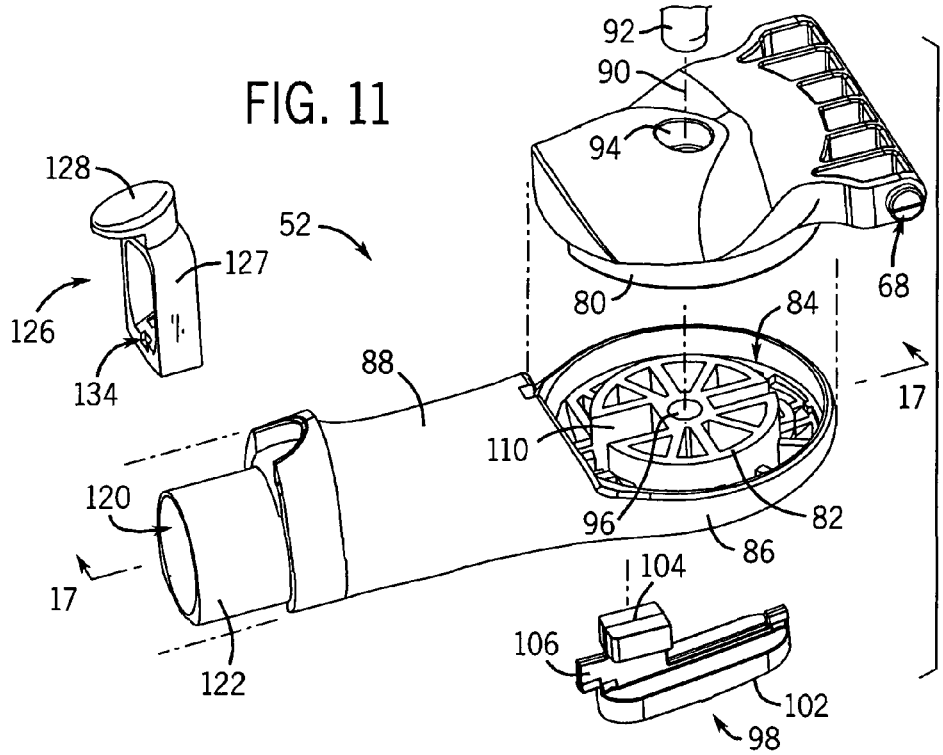
FIG. 11 is an exploded perspective view of the coupler.
Figure 12:
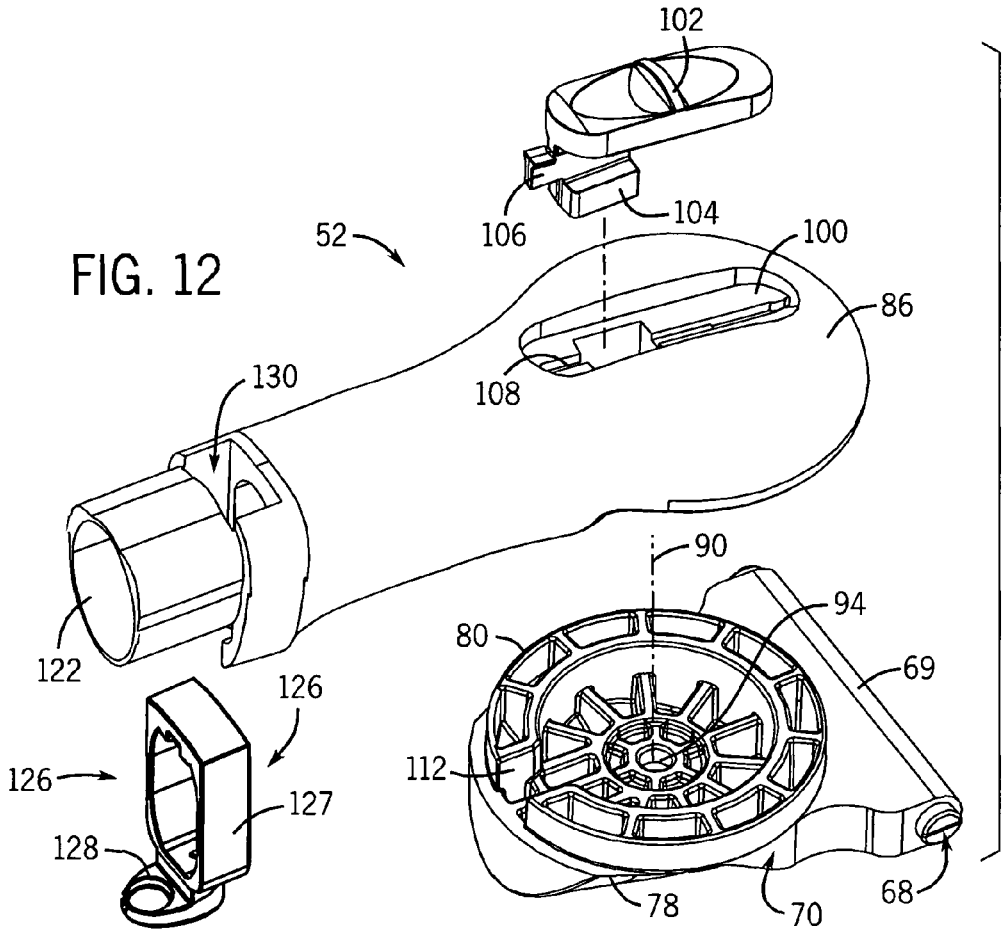
FIG. 12 is a reverse exploded perspective view of the coupler.

Referring now to FIGS. 5, 11-12 and 17-21, the opposite end of the coupler 52 provides a plug and socket type quick disconnect attachment with an end of the main body 16. In particular, the coupler 52 has a socket 120 with a tubular end 122 that receives a male plug end 124 of the main body 16 and fits inside of an end shroud 125 of the main body 16. The plug end 124 is retained in the socket 120 by a latch ring 126. As shown in FIG. 18, the latch ring 126 is generally ring-shaped element 127 with flat long sides and has a button 128 mounted at a short end by a snap-fit pin 129 and socket 131 connection. The latch ring 126 could, of course, be a single unitary component; however, it is shown in two parts here for ease of assembly. The latch ring 126 is slidably captured within a slot 130 in the coupler 52 and protrudes through opposite sides of the coupler 52. The latch ring 126 is biased by a spring 132 to be concentric with the main axis of the socket 120, as shown in FIGS. 5 and 19, so that a catch surface 134 of the latch ring 126 engages with a radial surface 136 of the plug end 124 to prevent axial separation of the main body 16 from the coupler 52.

The main body 16 can be quickly connected to the cleaning head 24 by sliding the plug end 124 into the socket 120. Doing so causes the radial surface 136 to cam against a ramped side 140 of the catch 134 and drive the latch ring 126 out of the way of the plug end 124, as shown in FIG. 20. Once the radial surface 136 passes the catch member 134 the spring 132 returns the latch ring 126 to its original position, as shown in FIG. 19. Depressing the button 128 against the spring 132 clears the catch member 134 from the radial surface 136 so that the plug end 124 can be slid out of the socket 120, as shown in FIG. 21.

Figure 22:
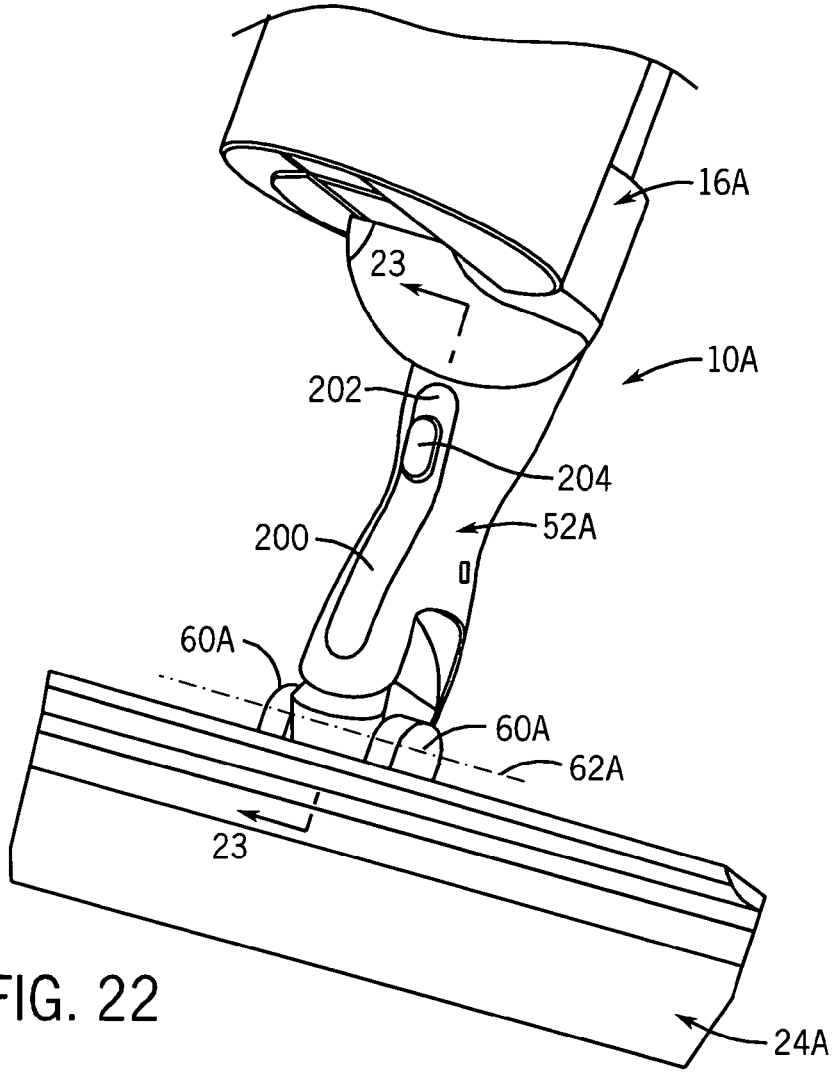
FIG. 22 is a partial perspective view of a second embodiment of the device having a quick disconnect coupler with opposing spring biased jaws.
Figure 23:
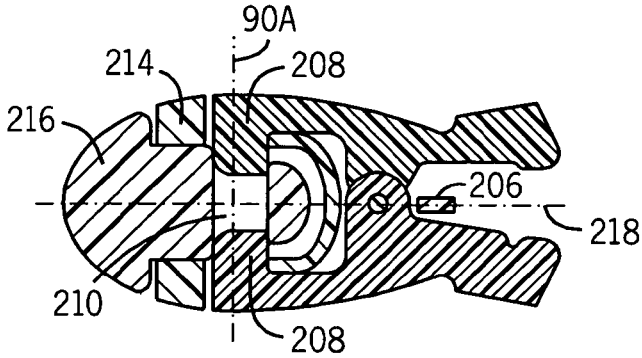
FIG. 23 is a partial cross-sectional view taken through line 23-23 of FIG. 22.

FIGS. 22 and 23 show an alternate embodiment of the cleaning device 10A of the present invention, shown here with a squeegee type cleaning head 24A and with a slightly modified main body 16A and retainer 20A assembly as well as an alternate coupler 52A assembly. Specifically, in this embodiment, the coupler 52A includes a coupler body 88A in which are pivotally mounted opposing jaws 200 having tail ends 202 with raised grips 204 biased outwardly by a spring 206. The spring 206 thus biases the jaws 200 to maintain teeth 208 in an opening 210 concentric with a swivel axis 90A of a swivel 212. Preferably, the swivel 212 has two parts 214 and 216 that are pivotally mated together about another swivel axis 218. The second part 216 is in turn pivotally mounted along a pivot axis 62A with spaced pivot mounts 60A fixed to the cleaning head 24A.

Depressing the grips 204 inwardly toward each other opens the jaws 200 and disengages the teeth 208 from the opening 210 in swivel part 212 so that the coupler 52A can be separated from the cleaning head 24A. The cleaning head 24A can be quickly reattached again by pressing in on the grips 204 and clamping the teeth 208 into the opening 210. This arrangement thus provides rapid connection and disconnection like the previously described embodiment. Also like before, this embodiment provides pivoting of the cleaning head 24A with respect to the main body 16A about two perpendicular pivot 62A and swivel 90A axes. In addition, it provides a fully 360 degree rotation about the third perpendicular swivel axis 218. Although not shown, various locking pins or other features could be provided to disable one or both of the swivel motions, as desired.

FIGS. 24-39 illustrate another version of the present invention in which the cleaning head can either swivel side to side or be locked into one of several preset angular positions, including perpendicular and other angles with respect to the device. For example, when the device is used with its extension wand as a mop to clean floors, the cleaning head could be allowed to swivel to get around objects on the floor and into corners. When the device is in its hand-held configuration, the swivel could be locked so that the cleaning head does not move as may be desired when cleaning windows and the like. Depending on the surface being cleaned and the user's relative position, the cleaning head can be locked perpendicular to the body of the device or at an oblique angle. Preferably, the cleaning head is free to pivot front to back in addition to the side to side swivel action.

Figure 24:
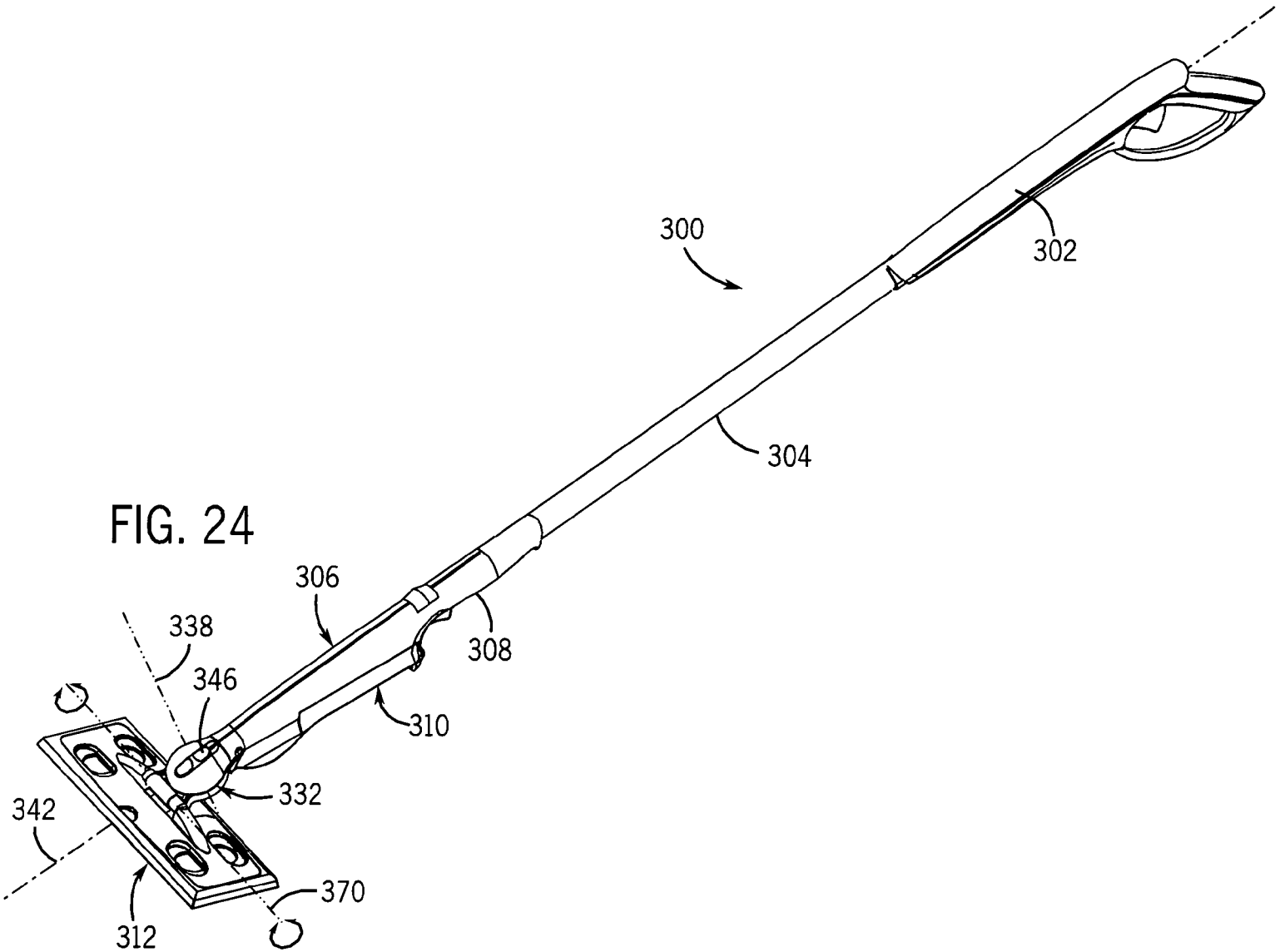
FIG. 24 is a front perspective view of another embodiment of the device having a removable snap-on adjustable cleaning head.
Figure 25:
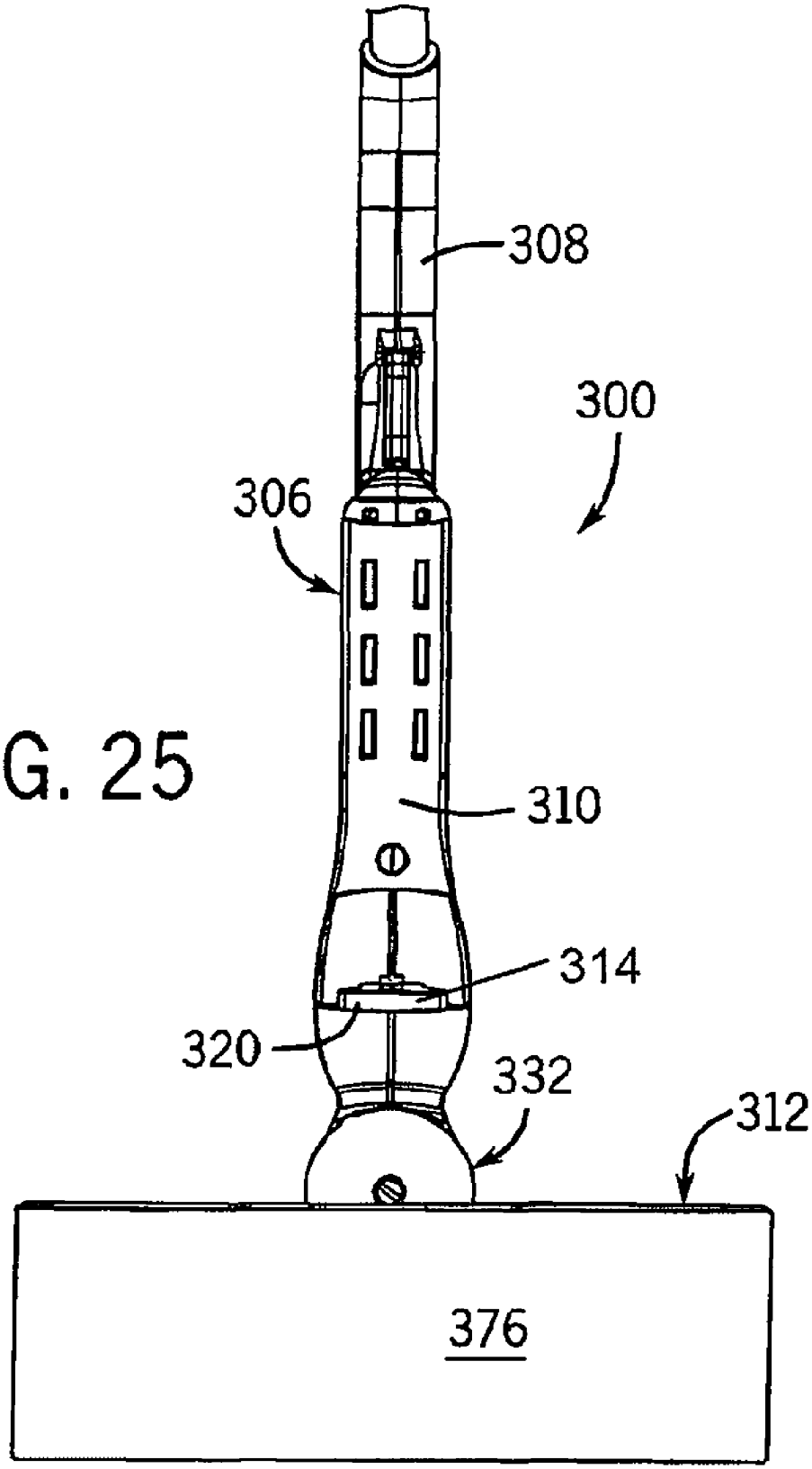
FIG. 25 is a partial back view of the cleaning head and the main body of the device.
Figure 26:
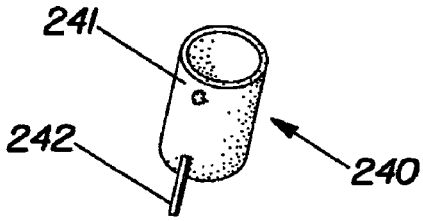
FIG. 26 is a front view thereof.
Figure 27:
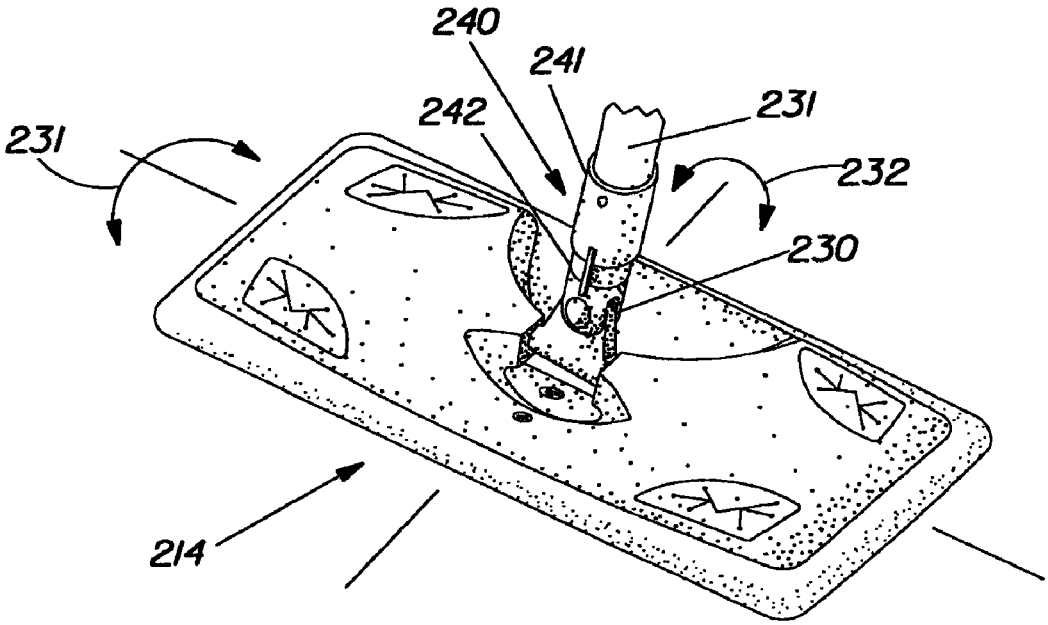
FIG. 27 is a partial perspective view showing the sliding canister mount on the body of the device.

FIGS. 24-26 illustrate this embodiment of the cleaning device 300 of the present invention fully assembled in a mop-like configuration for cleaning floors or out of reach vertical or horizontal surfaces. Although not shown specifically in this embodiment, the device can take on a hand-held configuration by removing an extension wand (similar to that shown in FIG. 2). This shorter configuration makes it easier to hold upright and to clean nearby surfaces.

Generally, the cleaning device 300 includes a remote grip assembly 302, an extension wand 304, a main body 306 having its own grip assembly 308 and an adjustable canister (like item 22 in FIG. 1) retainer assembly 310, and a cleaning head 312. The remote grip assembly 302 is generally the same as described above, having a hollow plastic pistol grip having a handle and a trigger. One or more hollow sections can make up the wand 304 and connect the remote grip 302 to the main body 306. Snap together and quick releasing socket connections allow for quick assembly and disassembly of the wand 304 and the remote grip 302. For a shortened device, the grip assembly 308 can be used, or the remote grip 302 can by directly connected to the main body 306 without the wand 304.

Within many of these components is a movable actuator assembly linking the triggers of the two grip assemblies to the valve of the canister for spraying cleaner contained therein near the cleaning head 312. Core pieces (not shown) of the actuator assembly slide in response to movement of either of the triggers and in turn pivot an actuator lever (not shown) to operate the valve of the canister. The canister is aligned and mounted to the main body 306 by the retainer assembly 310 (see FIG. 27), having a specially shaped toe stop 320, through which an end of the actuator lever protrudes when either of the triggers is depressed. A rail (not shown) mounts a heel assembly 322 having a slide 324 which rides on the rail. A locking tab 326 formed in the rail clicks into one of two receiver openings 328 at two preset adjustment locations to alternatively hold full or compact sized canisters. The canister is inserted into and removed from the retainer assembly 310 by depressing the locking tab 326 so that it clears the receiver opening thereby allowing the slide 324 to slide on the rail. Generally the slide 324 is moved away from the toe stop 320 to make room to insert the canister and then moved toward the toe stop 320 to clamp the canister in place. A spring biased latch 330 engages the inside of the bottom rim of the canister to prevent it from falling out when upside down.

In operation, a user generally utilizes the cleaning device 300 like any conventional poled or hand-held aerosol spray cleaning device. When desired, the user simply squeezes a trigger to move the hidden actuating linkage, which pivot a hinged part of an overcap on the canister to open the canister valve and spray out cleaner. When the trigger is released, a spring biases the actuator linkage to its original, non-activated position, which allows the canister valve to close and stop spraying.

Figure 28:
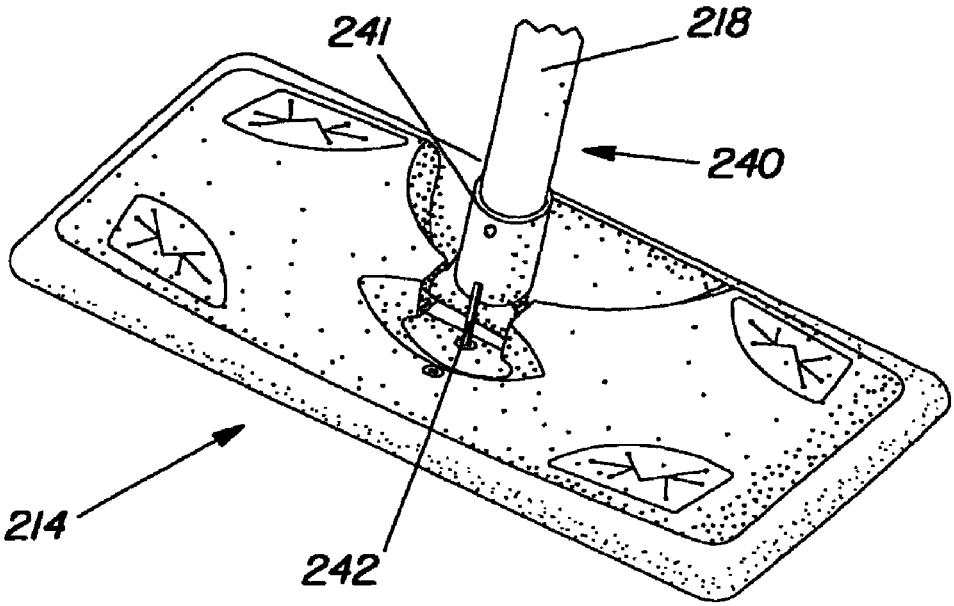
FIG. 28 is a partial front perspective view showing the adjustable connection of the cleaning head of the device of FIG. 24.
Figure 29:
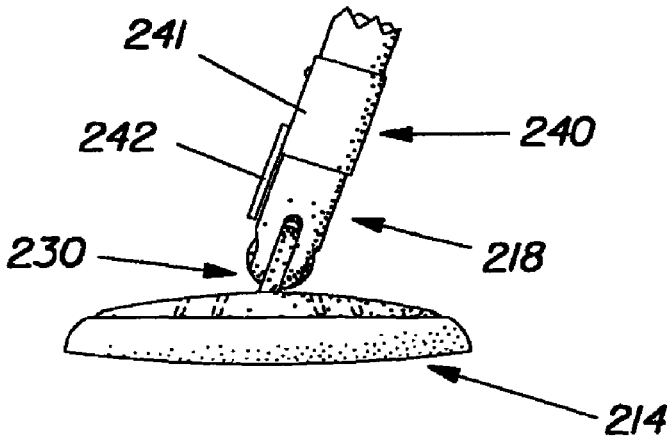
FIG. 29 is a view similar to FIG. 28 albeit illustrating the swivel action of the cleaning head with respect to the body of the device.
Figure 30:
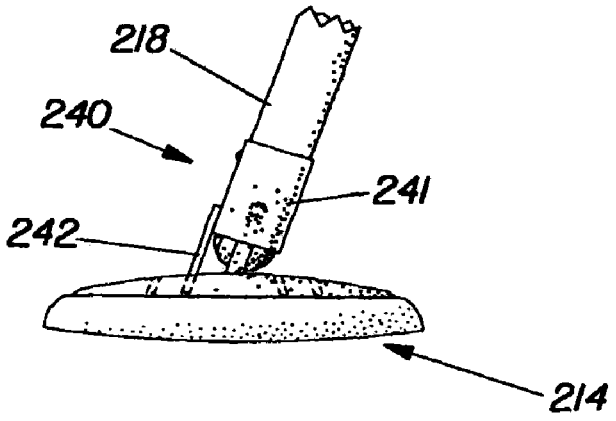
FIG. 30 is a partial exploded view of a lockable pivot connection between the cleaning head and the body of the device.
Figure 31:
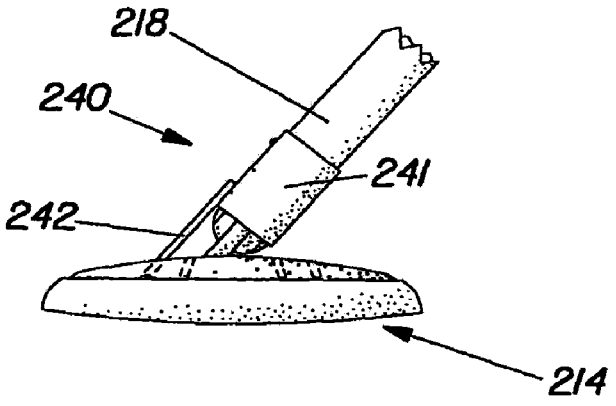
FIG. 31 is a perspective view of a stationary part of a swivel coupler.

As shown in FIGS. 28-30, the opposite end of the main body 306 connects to the cleaning head 312 by a coupler 332. The coupler 332 provides for, as mentioned above, both side to side swiveling of the cleaning head 312 with respect to the body 306 as well as front to back pivotal motion. The coupler 332 includes a stationary (or non-swiveling) part 334 and a swivel 336. The swivel 336 is a separate component that rotatably mounts to the stationary part 334 along a swivel axis 338 (see FIG. 24), for example by a pin, rivet or bolt. The stationary part 334 can be a separate part from the body 306 (as shown in FIG. 31) in which an end fits into a socket at the end of the body 306 and is fastened in place. Or, while not shown herein, the stationary part could be a unitary part of the body 306, for example formed integrally therewith in a single molding operation.

Figure 33:
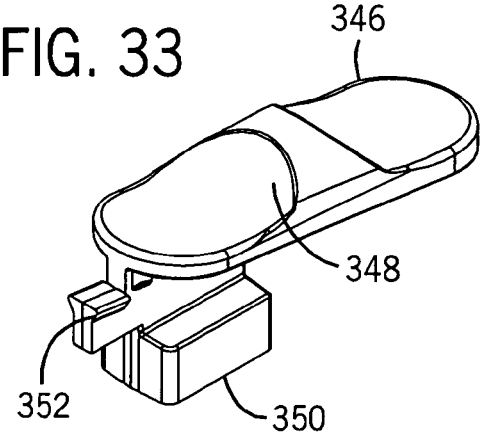
FIG. 33 is a perspective view of a swivel lock of the swivel coupler.
Figure 34:
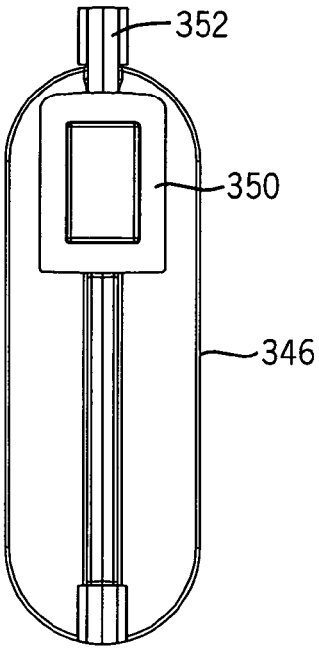
FIG. 34 is a bottom view thereof.
Figure 32:
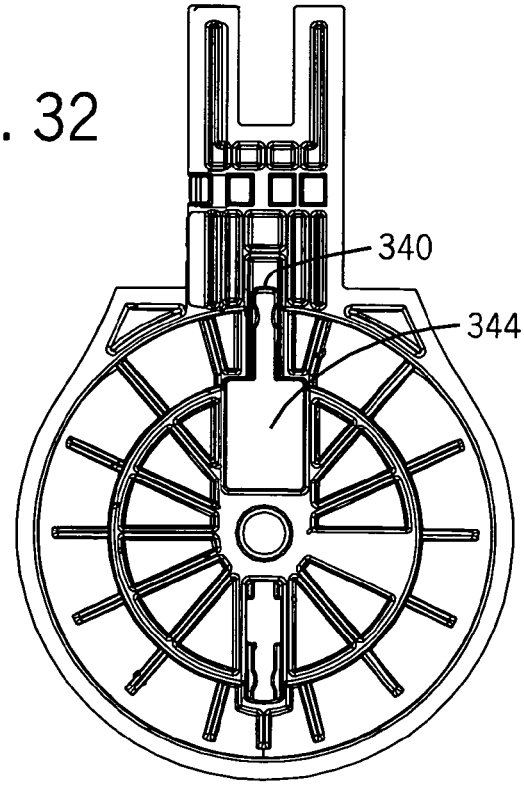
FIG. 32 is a bottom view thereof.
Figure 36:
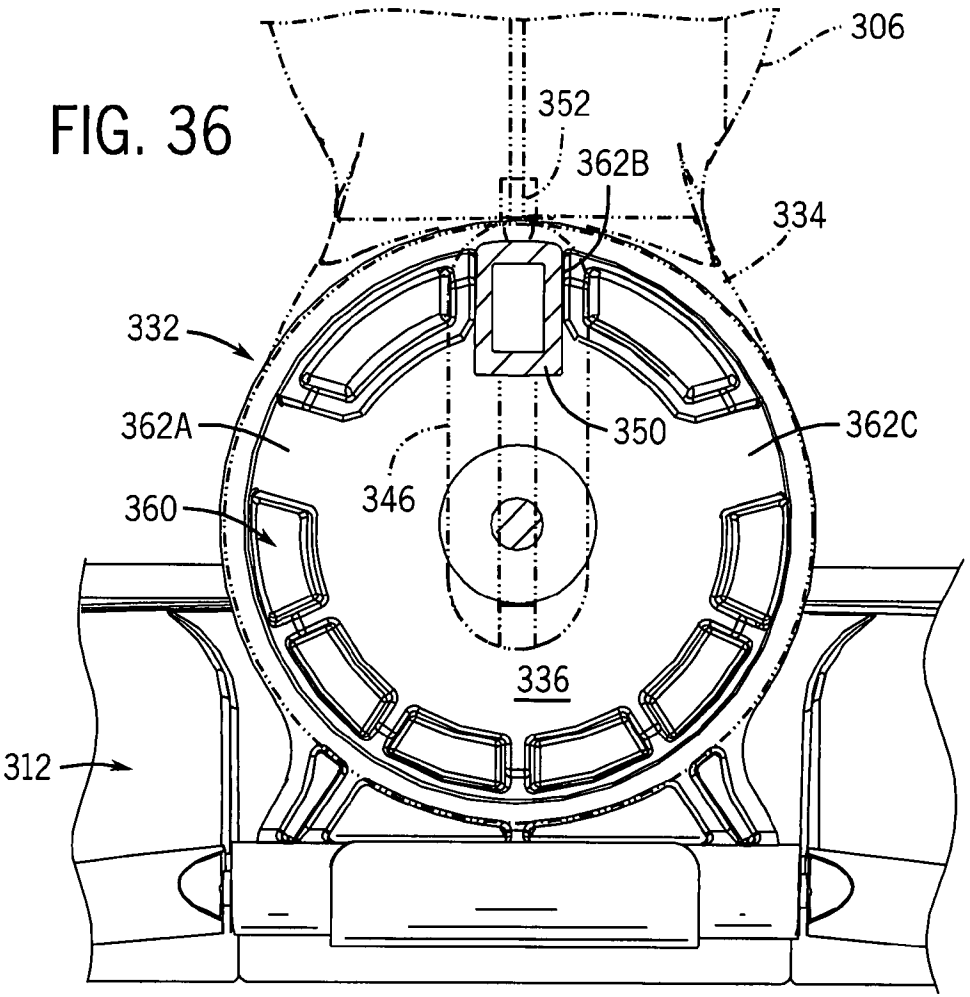
FIG. 36 is a partial sectional view of the swivel coupler assembled to the cleaning head and the body of device and in a locked position, with the stationary part of the swivel coupler should in phantom and the swivel loc.
Figure 35:
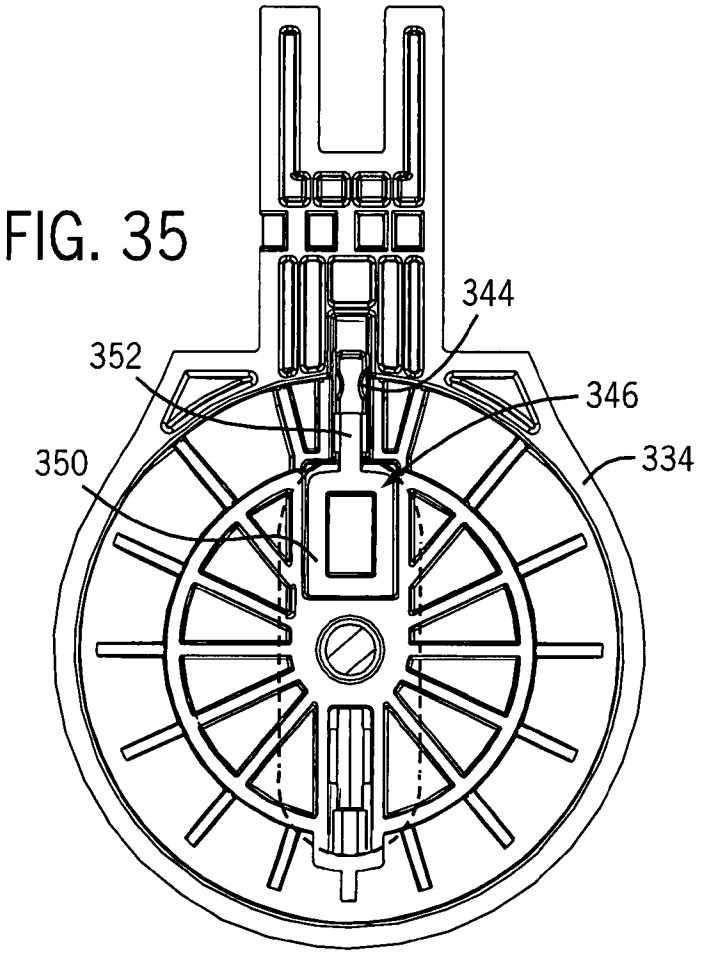
FIG. 35 is a bottom view of the swivel lock assembled to the stationary part of the swivel coupler.
Figure 37:
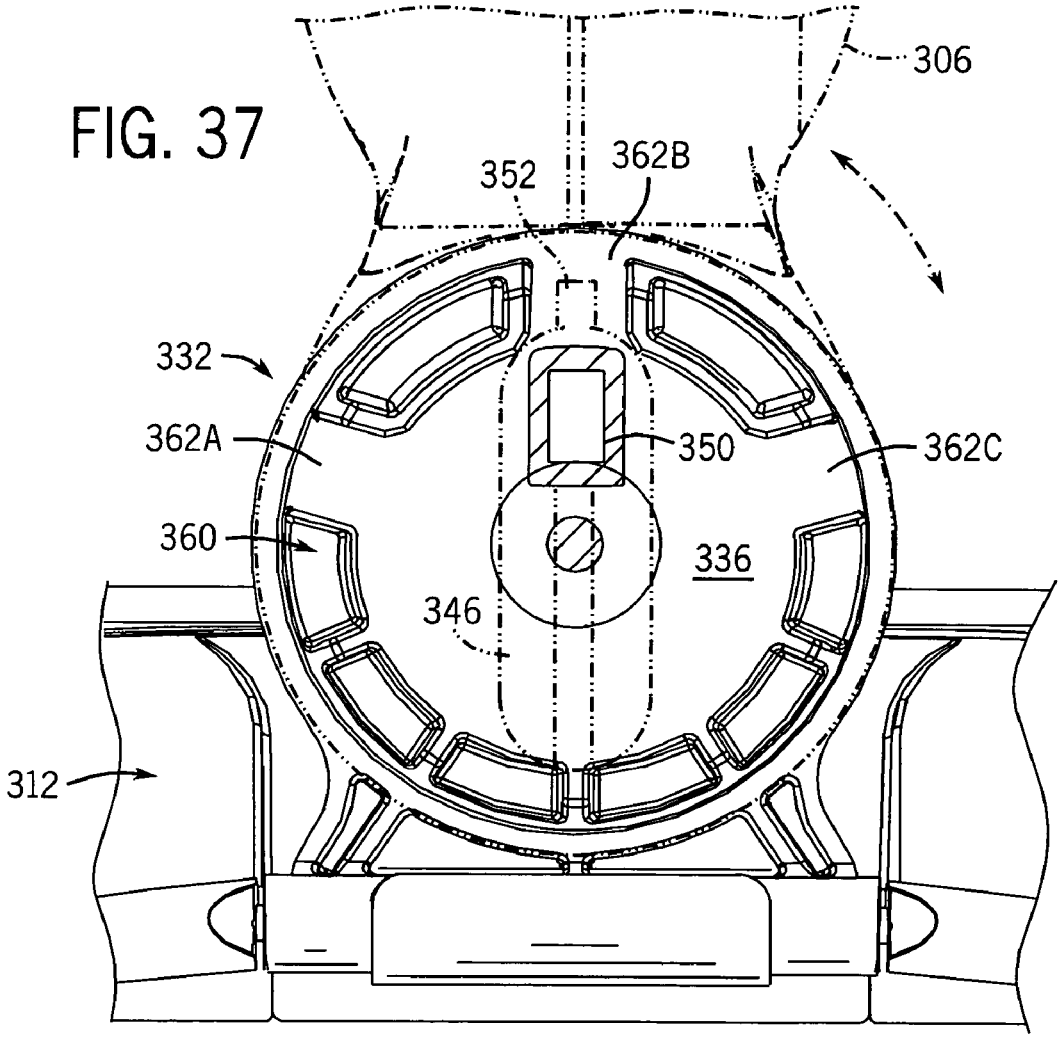
FIG. 37 is a view similar to FIG. 36 albeit with the swivel lock in an unlocked or swivel position.

As shown in FIGS. 31 and 32, the stationary part 334 has a round end defining a circular area perpendicular to the swivel axis 338. The stationary part 334 is bolstered by several internal ribs designed to provide strength with reduced material usage. The ribs define a small pocket or slot 340 extending along a longitudinal axis 342 of the body 306 and opening at the periphery of the circular area. The stationary part 334 also defines a slot 344 extending along the longitudinal axis 342 (see FIG. 24) in which a swivel lock 346 can fit (as shown in FIG. 35) and can slide between locked (FIG. 38) and swivel (FIG. 39) positions. As shown in FIGS. 33 and 34, the swivel lock 346 has on outer grip 348 which extends to one side of the coupler (see e.g. FIG. 28) and a stop 350 with a narrowed neck section 352. The neck section 352 is designed to fit into the slot 344 when the swivel lock 346 is moved into the locked position. As shown in FIGS. 36 and 37, the swivel 336 has a round end that defines a generally circular section 360 extending axially concentric with the swivel axis 338. The circular section 360 defines several radial slots 362 spaced apart circumferentially. These slots are sized to accept the stop 350 of the swivel lock 346 when aligned with the longitudinal axis 342 and when it is moved to the locked position. In the preferred form shown in the drawings, there are three radial slots 362A-C, at approximately 10, 12 and 2 o'clock in FIG. 36. Slot 362B is a centering slot in which when aligned with the longitudinal axis 342 the cleaning head 312 is perpendicular to the body 306. The other two slots 362A and 362C allow the cleaning head to be held at an oblique (non-perpendicular) angle with respect to the body 306. Preferably, the slots are spaced apart between 10 and 45 degrees, and more preferably if there are three or more slots the spacing would be between 10-20 degrees.

Figure 38:
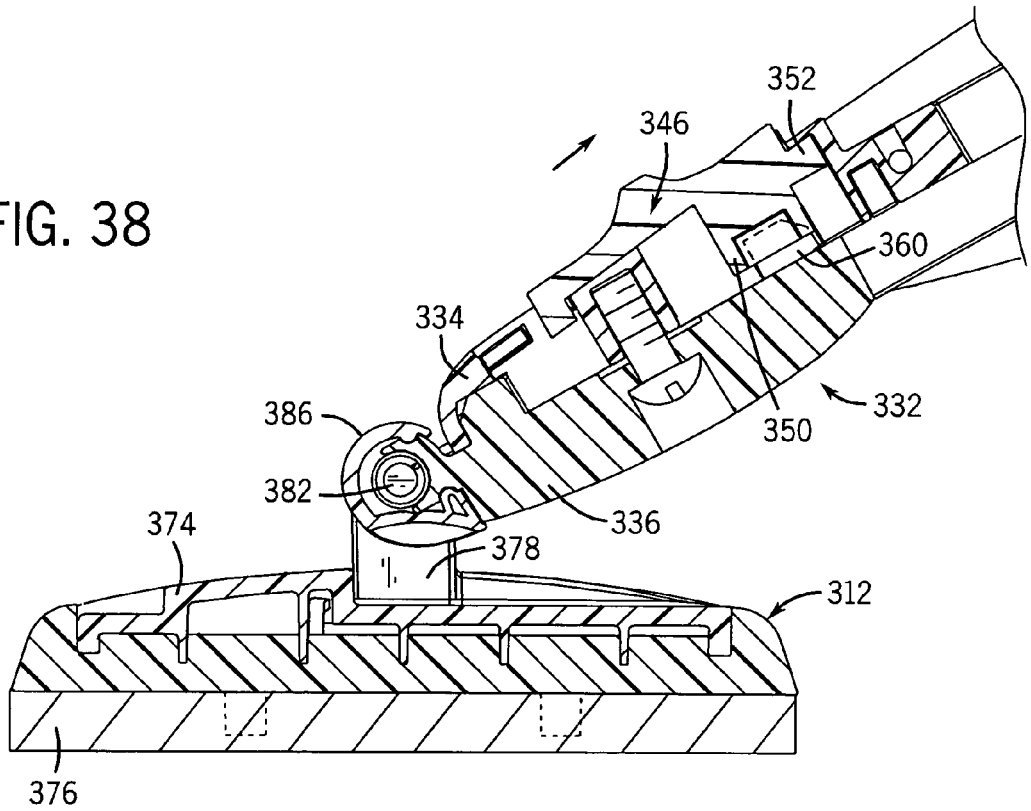
FIGS. 38 and 39 are side sectional views taken along line 38-38 of FIG. 28 showing the swivel lock in the locked and unlocked positions, respectively.
Figure 39:
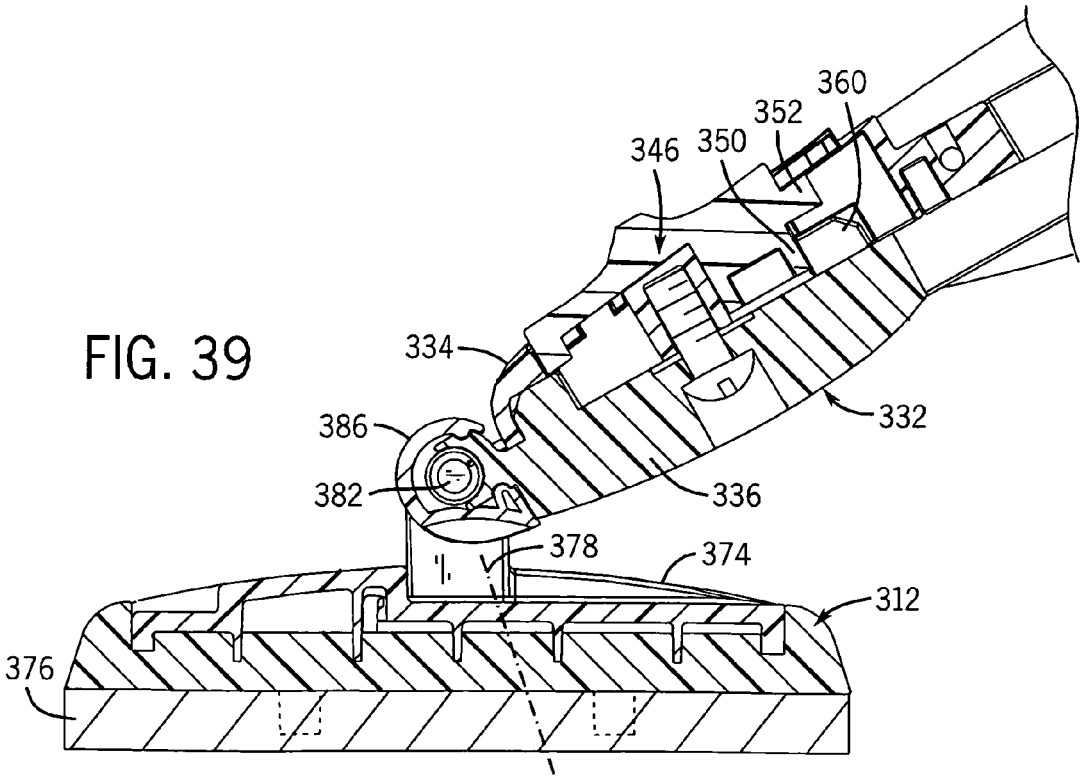

FIGS. 36 and 38 illustrate the swivel 336 locked in a centered position and FIGS. 37 and 39 illustrate the swivel 336 unlocked so that it is free to swivel about the swivel axis 338 with respect to the body 306. When the swivel lock 346 is in the locked position, the stop 350 fits into the radial slot 362 (in this case 362B) and the neck 352 slides into slot 344 in the stationary part 334 of the coupler 332. The stop 350 thus interferes with movement of the radial surfaces defining the slot 362B and thereby prevents any meaningful rotation of the swivel 336. By sliding the swivel lock 346 to the unlocked position, the stop 350 (and neck 352) leaves the slot 362 (and the neck leaves slot 344) to allow rotation of the swivel 336. This arrangement thus allows the swivel 336 to be disabled quickly and easily when not needed or when a more rigid connection is desired. The angular position of the cleaning head 312 also can be quickly changed by sliding the swivel lock 346 to the unlocked position, rotating the swivel 336 to align slots 362A or 362C with the longitudinal axis and then re-locking the swivel 336. Registration markings can be provided on the swivel 336 (and stationary part 334) to visually aid in alignment.

Referring again to FIGS. 28-30, the cleaning head 312 is pivotally mounted to the swivel 336 about a pivot axis 370, which is perpendicular to the swivel axis 338. Specifically, the cleaning head 312 has a pivot mount 372 formed as an integral part of a backing plate 374 supporting a compressible pad 376. It should be noted that as in prior embodiments, the pad 376 can be a substrate for mounting a cleaning cloth or dusting sheet or it may be a sponge or scrubber pad, and the backing plate 374 and pad 376 could be replaced by a bristled brush head, wiper blade or any other suitable cleaning implement desired. In any event, the pivot mount 372 is formed by two upstanding fixed mounts 378 spaced apart along the pivot axis 370 and defining two facing pivot holes 380. These two pivot holes 380 receive two pivot pins 382 slidably housed in the swivel 336. The pivot pins 382 are biased apart by a spring 384 covered by a partially cylindrical, snap-on pivot lock 386. Both pins 382 can slide in and out of the swivel 336 against the spring 384 so that the cleaning head 312 can snap straight onto the coupler 332. The pins 382 deflect inward as they come in contact with their associated mount 378 until they clear the contacting surfaces and are able to extending into the pivot holes 380 by the force of the spring 384. This is eased by the cammed or tapered ends 386 of the pins 382. The resulting connection locks the cleaning head 312 to the coupler 332, and thus the body 306, while permitting front to back relative pivoting about the pivot axis 370. Sliding the pivot lock 386 from its resting position, preferably by inserting one's thumb into a thumb grip 388, causes it to engage one of the pins 382 and retract it against the spring 384. This allows the retracted pin to clear its mount by manually pivoting the device up or to the side. The other (extended) pin can then be pulled out of the associated pivot hole to completely separate the cleaning head 312 from the coupler 332, and thus the body 306 of the cleaning device 300. A more detailed explanation and illustration of the pivot arrangement is provided in co-pending U.S. application entitled "Cleaning Device With Removable Snap-on Head", the entire disclosure of which is hereby incorporated by reference as though fully set forth herein.

It should be appreciated that preferred embodiments of the invention have been described above. However, many modifications and variations to these preferred embodiments will be apparent to those skilled in the art, which will be within the spirit and scope of the invention. Therefore, the invention should not be limited to the described embodiments. To ascertain the full scope of the invention, the following claims should be referenced.

INDUSTRIAL APPLICABILITY

The invention is cleaning device having an improved swivel connection allowing rapid angular adjustment of the cleaning head.

What is claimed is:

1. A cleaning device, comprising:

a handle;

a cleaning head having a front, back and opposite sides; and a coupler joining the handle to the cleaning head, wherein the cleaning head is movable with respect to the coupler about a pivot axis in a front to back direction, wherein the coupler has a lock movable with respect to a swivel which is rotatable about a swivel axis in a side to side direction, wherein the swivel axis is substantially perpendicular to the pivot axis, and wherein the lock releasably locks the swivel in one of a plurality of discrete angular positions about the swivel axis through radial movement of the lock relative to the swivel axis, at least one of the angular positions creating an oblique angle between the handle and the cleaning head in a direction towards one of said opposite sides, yet does not restrict front-to-back pivoting of the cleaning head about the pivot axis relative to the handle, wherein the head remains movable about the pivot axis relative to the handle when the lock is locked in a locked position with respect to the swivel axis;

wherein the swivel includes a slot that is substantially perpendicular to the swivel axis, and wherein the lock engages the slot only when the swivel is locked.

2. A cleaning device according to claim 1, wherein the swivel includes a plurality of slots angularly spaced apart from one another, each slot being substantially perpendicular to the swivel axis, wherein the lock engages a desired one of the plurality of slots only when the swivel is locked.

3. The cleaning device of claim 2, wherein the swivel lock has a thumb grip at a side of the coupler.

4. The cleaning device of claim 2, wherein the swivel lock slides relative to the swivel.

5. The cleaning device of claim 2, wherein a centering one of said plurality of slots is located so that when the lock engages the centering slot the cleaning head is perpendicular to the handle.

6. The cleaning device of claim 5, wherein an angling one of said plurality of slots is located so that when the lock engages the angling slot the cleaning head is at an oblique angle to the handle.

7. The cleaning device of claim 5, wherein the plurality of slots comprises at least three slots angularly spaced apart with between 10 and 45 degrees between each slot.

8. The cleaning device of claim 1, wherein a stationary part of the coupler is integral with the handle.

9. The cleaning device of claim 1, wherein the swivel couples to the cleaning head in a one-way snap together releasable locking pivot connection.

10. The cleaning device of claim 1, wherein the handle has a body that mounts an aerosol canister assembly for delivering a chemical from a canister to a desired location adjacent the cleaning head.

11. The cleaning device of claim 10, wherein the handle includes a grip assembly having a trigger for moving an actuator assembly causing the chemical to be dispensed from the canister when the trigger is depressed.

* * * * *